US010843363B2

(12) United States Patent
Gereg

(10) Patent No.: US 10,843,363 B2
(45) Date of Patent: Nov. 24, 2020

(54) KNIFE ASSEMBLIES AND CUTTING APPARATUSES COMPRISING THE SAME

(71) Applicant: URSCHEL LABORATORIES, INC., Chesterton, IN (US)

(72) Inventor: Dustin Joseph Gereg, Lowell, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 0 days.

(21) Appl. No.: 16/186,998

(22) Filed: Nov. 12, 2018

(65) Prior Publication Data

US 2019/0143554 A1 May 16, 2019

Related U.S. Application Data

(60) Provisional application No. 62/584,245, filed on Nov. 10, 2017.

(51) Int. Cl.

| | |
|---|---|
| ***B26D 7/06*** | (2006.01) |
| ***B26D 7/26*** | (2006.01) |
| ***B26D 1/03*** | (2006.01) |
| *B26D 3/18* | (2006.01) |

(52) U.S. Cl.

CPC ..... *B26D 7/2614* (2013.01); *B26D 1/03* (2013.01); *B26D 7/0691* (2013.01); *B26D 3/185* (2013.01); *B26D 2210/02* (2013.01)

(58) Field of Classification Search

CPC .. B26D 3/185; B26D 7/0691; B26D 2210/02; B26D 3/18

USPC ..... 83/403

See application file for complete search history.

(56) References Cited

U.S. PATENT DOCUMENTS

| | | | | |
|---|---|---|---|---|
| 2,581,501 A * | 1/1952 | Shaver | ..... | B26D 3/185 83/679 |
| 2,822,004 A * | 2/1958 | Rudolph | ..... | B26D 3/185 83/425.2 |
| 3,139,129 A | 6/1964 | Urschel et al. | | |
| 3,208,309 A * | 9/1965 | Popeil | ..... | B26D 3/185 76/101.1 |
| 3,392,768 A | 7/1968 | Anliker | | |
| 3,472,297 A | 10/1969 | Urschel et al. | | |
| 3,521,688 A | 7/1970 | Urschel et al. | | |
| 4,590,835 A | 5/1986 | Matsuo | | |

(Continued)

OTHER PUBLICATIONS

International Search Report and Written Opinion for International Application No. PCT/US2018/060596, filed Nov. 13, 2018, dated Feb. 27, 2019, 12 pages.

*Primary Examiner* — Kenneth E Peterson

(74) *Attorney, Agent, or Firm* — Hartman Global IP Law; Gary M. Hartman; Domenica N. S. Hartman

(57) ABSTRACT

Knife assemblies and cutting apparatuses adapted for producing strip-cut products, for example, a strip-cut food product. The knife assemblies include a slicing knife having a leading edge configured to produce a slice product from a product, at least one tab that extends outward from the slicing knife and configured to cut the slice product into strips, a knife holder for securing the slicing knife and fixing a proximal end of the tab to a position adjacent to the slicing knife, and a tab support assembly configured to clamp onto a distal end of the tab and optionally pull the tab in a direction away from the knife holder along a longitudinal axis of the tab to apply tension to the tab.

14 Claims, 20 Drawing Sheets

(56) References Cited

U.S. PATENT DOCUMENTS

| | | | | | |
|---|---|---|---|---|---|
| 5,249,494 | A * | 10/1993 | Borvitz | B26D 3/18 | 83/302 |
| 5,661,909 | A * | 9/1997 | Kondo | B23D 51/10 | 279/53 |
| 5,694,824 | A | 12/1997 | Jacko et al. | | |
| 5,896,801 | A | 4/1999 | Jacko | | |
| 5,911,808 | A * | 6/1999 | Mendenhall | B26D 1/48 | 30/117 |
| 6,047,625 | A * | 4/2000 | Mendenhall | B26D 3/185 | 83/856 |
| 6,725,765 | B1 * | 4/2004 | Mendenhall | B26D 1/0006 | 83/402 |
| 6,968,765 | B2 | 11/2005 | King | | |
| 9,469,041 | B2 | 10/2016 | King et al. | | |
| 9,840,015 | B2 | 12/2017 | King et al. | | |
| 9,849,600 | B2 | 12/2017 | King et al. | | |
| 10,369,641 | B2 * | 8/2019 | Myers | B23D 49/007 | |
| 2001/0042428 | A1 * | 11/2001 | Jensen | B26D 3/185 | 83/402 |
| 2010/0015312 | A1 | 1/2010 | Bellmunt-Molins et al. | | |
| 2010/0236372 | A1 | 9/2010 | Desailly et al. | | |
| 2013/0276604 | A1 | 10/2013 | King et al. | | |
| 2015/0107426 | A1 | 4/2015 | King et al. | | |
| 2017/0072579 | A1 | 3/2017 | Reis et al. | | |
| 2017/0232630 | A1 * | 8/2017 | Underwood | B26D 3/18 | 83/44 |

* cited by examiner

KNIFE ASSEMBLIES AND CUTTING APPARATUSES COMPRISING THE SAME

CROSS REFERENCE TO RELATED APPLICATIONS

This application claims the benefit of U.S. Provisional Application No. 62/584,245, filed Nov. 10, 2017. The contents of this prior application are incorporated herein by reference.

BACKGROUND OF THE INVENTION

The present invention generally relates to methods and equipment for performing size reduction operations on products, including but not limited to food products.

Various types of equipment are known for reducing the size of products, for example, slicing, strip-cutting, dicing, shredding, and/or granulating food products such as vegetable, fruit, dairy, and meat products. Particular examples of machines for this purpose include centrifugal-type cutting apparatuses commercially available from Urschel Laboratories, Inc., under the names DiversaCut 2110® and Model CC®. The DiversaCut 2110® and Model CC® machine lines employ an impeller coaxially mounted within a cutting head, which is generally annular-shaped with one or more knife assemblies arranged in sets spaced around its circumference. During operation, the impeller rotates within the cutting head while the latter remains stationary, and centrifugal forces cause products to move outward into engagement with the knife assemblies of the cutting head. Both types of machines are adapted to uniformly slice, strip-cut, shred, granulate, and/or dice a wide variety of vegetables, fruits, and meat products at high production capacities. Descriptions pertaining to the construction and operation of Model CC® machines are contained in U.S. Pat. Nos. 5,694,824 and 6,968,765. Descriptions pertaining to the construction and operation of DiversaCut 2110® machines are contained in U.S. Pat. Nos. 3,472,297 and 3,521,688. The entire contents of these prior patent documents are incorporated herein by reference.

A nonlimiting embodiment of a Model CC® machine is represented in FIG. 1, which schematically represents an annular-shaped cutting head 10 mounted on a support ring 15 above a gear box 17. A housing 19 contains a shaft coupled to the gear box 17, through which an impeller 11 is driven within the cutting head 10. Products for cutting are provided through a feed chute 13. As previously noted, the impeller 11 rotates within the cutting head 10, and paddles 11A located adjacent the perimeter of the impeller 11 cause products to move outward into engagement with knives (not shown) arranged around the circumference of the cutting head 10. Each knife projects radially inward toward the impeller 11 in a direction generally opposite the direction of rotation of the impeller 11, and defines a cutting edge at its radially innermost extremity.

FIG. 2 contains a perspective view of a particular embodiment of the cutting head 10 of FIG. 1. The cutting head 10 is represented as equipped with shaped (in other words, other than flat, for example, corrugated) knives 12 that are adapted for producing shaped (as opposed to flat) sliced food products. The cutting head 10 further includes lower and upper support rings 14 and circumferentially-spaced support segments, referred to herein as shoes 18, to which the knives 12 are mounted as members of knife assemblies 16. Each knife assembly 16 comprises a clamping assembly for securing its knife 12 to a shoe 18. Each clamping assembly includes a knife holder mounted to the radially inward-facing side of a shoe 18, and a clamp mounted on the radially outward-facing side of the shoe 18 to secure its knife 12 therebetween.

FIG. 3 contains a side view of another particular embodiment of a cutting head 20 that can be used in the Model CC® machine of FIG. 1. The cutting head 20 of FIG. 3 is represented as equipped with multiple knife assemblies 26, each comprising a set of knives 22 and 23 that are assembled as shown in FIG. 4. Similar to the cutting head 10 of FIG. 2, FIG. 3 shows each knife assembly 26 as individually securing its set of knives 22 and 23 to one of a number of circumferentially-spaced shoes 28 mounted to lower and upper support rings 24 of the cutting head 20. FIG. 5 shows a detailed view of one of the shoes 28 and knife assemblies 26, the latter of which is shown as including a knife holder 30 and knife clamp 31 that clamp the knives 22 and 23 therebetween. The knife assemblies 26 are adapted for producing flat (as opposed to shaped) strip-cut food products, also referred to herein as julienne-cut food products. FIG. 4 represents the knife 22 as being a flat (planar) slicing knife 22 that defines a cutting edge 21, and the remaining knife 23 (referred to herein as a "julienne" or "strip" knife) as having a flat base and individual blades, referred to herein as "tabs" 25, that are oriented roughly perpendicular to the base to produce, in combination with the slicing knife 22, strip-cut (julienne-cut) flat food products. In operation, the cutting edge 21 of the slicing knife 22 cuts a slice of the food product, after which the strip knife 23 cuts the slice into strips.

FIG. 6 shows an exploded view of another knife assembly 36 and a corresponding shoe 38 of a type configured to be used in a Model CC® cutting head (as nonlimiting examples, of the types shown in FIGS. 2 and 3). The knife assembly 36 includes a knife holder 40 and a knife clamp 42 secured thereto with bolts 44, and the knife holder 40 is adapted to be secured to the shoe 38 with bolts 46. The knife holder 40 and knife clamp 42 are represented as holding a flat slicing knife 32 and a pair of strip knives 33A and 33B, in contrast to the single strip knife 23 of FIG. 4. The knife clamp 42 includes a plurality of slots in a leading edge thereof that provide openings through which tabs 35A and 35B of the strip knives 33A and 33B extend. When assembled, the strip knives 33A and 33B are arranged such that their tabs 35A and 35B, respectively, alternate along the longitudinal length of the knife assembly 36. The flat slicing knife 32 and the strip knives 33A and 33B function in substantially the same manner as described above for the flat slicing knife 22 and strip knife 23 of FIGS. 3 through 5 to produce julienne-cut food product slices and strips.

While it should be evident that the Model CC® line of machines and knives of the type discussed above in reference to FIGS. 1 through 6 can be used to produce various types of cut food products, manufacturing challenges arise if attempting to increase the desired tab height (i.e., the dimension of a tab from the base of the strip knife to the outermost edge at the distal end of the tab oppositely disposed from the base). In particular, relatively long tabs may be at risk of flexing, bending, plastically deforming, and/or breaking during operation. As such, tab heights are generally limited on current machines. Therefore, improved equipment and methods are desirable for producing sliced food products.

BRIEF DESCRIPTION OF THE INVENTION

The present invention provides knife assemblies and cutting apparatuses suitable for producing strip-cut products, as a nonlimiting example, food product strips.

According to one aspect of the invention, a knife assembly adapted for cutting a product is provided that includes a slicing knife having a leading edge and configured to produce a slice product from the product, at least one tab that extends outward from the slicing knife and is configured to cut the slice product into strips, a knife holder for securing the slicing knife and fixing a proximal end of the tab to a position adjacent to the slicing knife, and a tab support assembly configured to clamp onto a distal end of the tab and pull the tab in a direction away from the knife holder along a longitudinal axis of the tab to apply tension to the tab.

According to another aspect of the invention, a cutting apparatus is provided that includes a cutting head having one or more knife assemblies arranged in sets spaced around the circumference of the cutting head, an impeller having paddles and configured to rotate within the cutting head such that products are contacted with the paddles and directed radially outward toward the knife assemblies at the circumference of the cutting head, wherein radial directions extend perpendicularly from an axis of rotation of the impeller toward the circumference of the cutting head. Each of the knife assemblies includes a slicing knife having a cutting leading edge and configured to produce a slice product from a product, at least one tab that extends outward from the slicing knife and is configured to cut the slice product into strips, a knife holder for securing the slicing knife and fixing a proximal end of the tab to a position adjacent to the slicing knife, and a tab support assembly positioned radially outward from the knife holder and configured to clamp onto a distal end of the tab and pull the tab away from the knife holder along a longitudinal axis of the tab to apply tension to the tab.

Technical effects of the knife assembly and cutting apparatus described above preferably include the ability to produce product strips with a reduced likelihood of damage occurring to the tab during the cutting operation due to the tension applied thereto.

Other aspects and advantages of this invention will be further appreciated from the following detailed description.

DETAILED DESCRIPTION OF THE INVENTION

Figure 1:
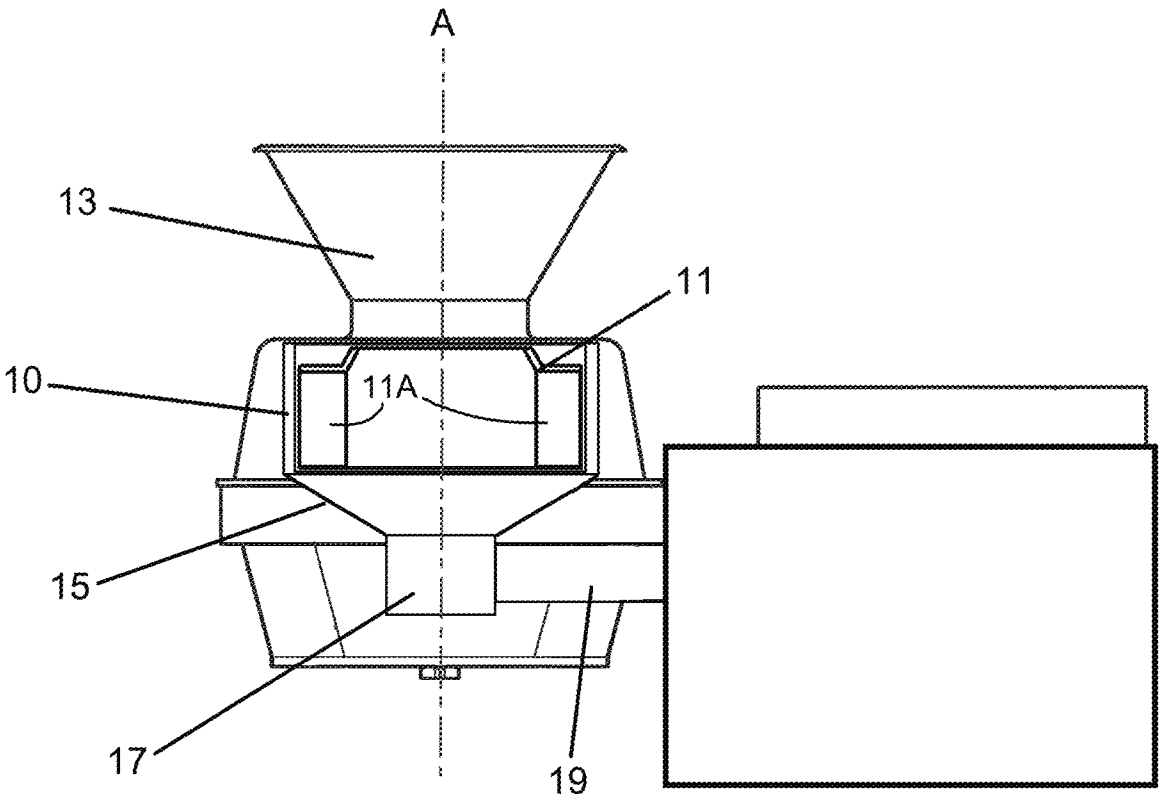
FIG. 1 (Prior Art)
FIG. 1 is a plan view representing a cutting apparatus known in the art.
Figure 2:
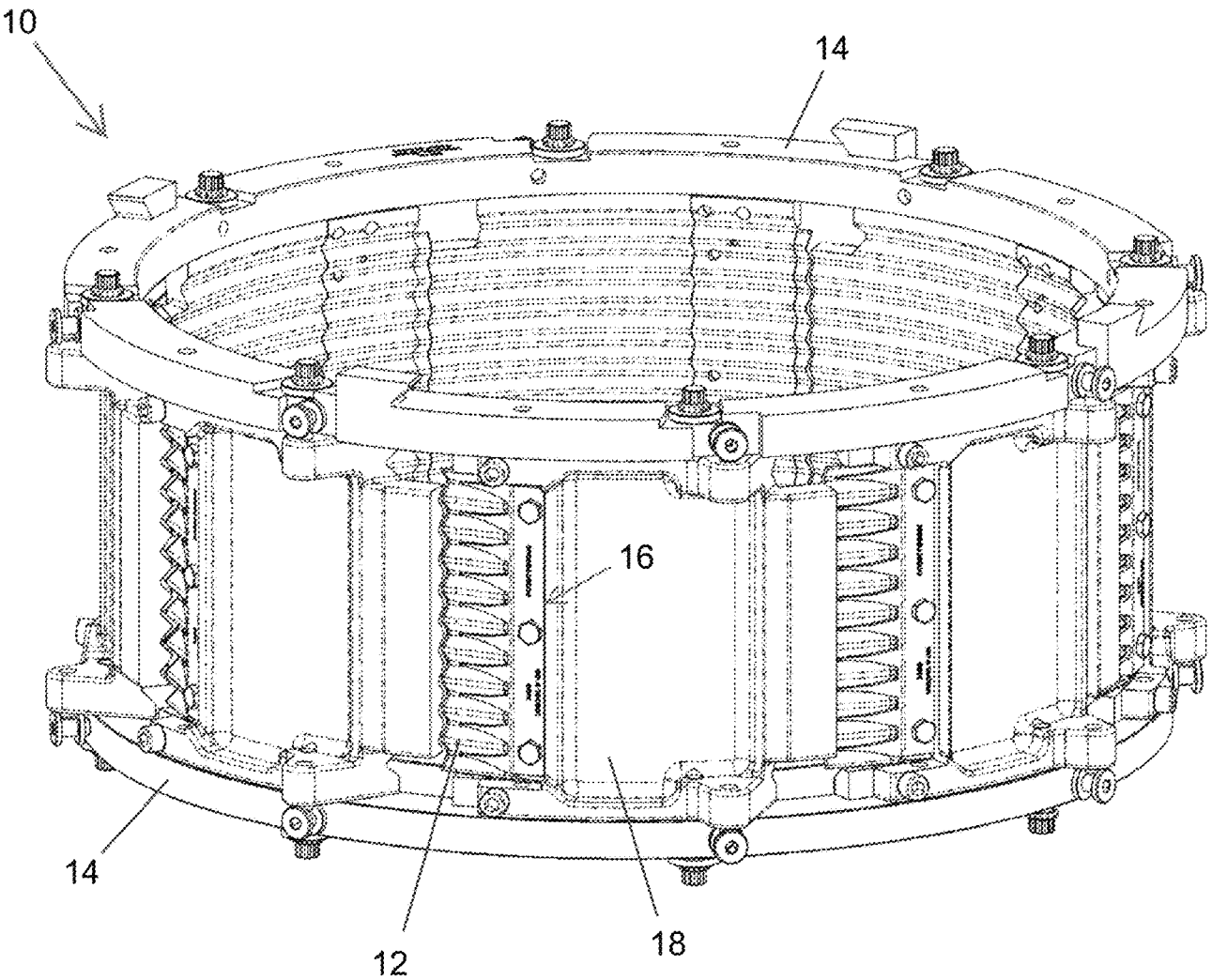
FIG. 2 (Prior Art)
FIG. 2 is a perspective view representing a cutting head of an existing Model CC® machine equipped with shaped knives that are adapted for producing shaped sliced food products.
Figure 3:
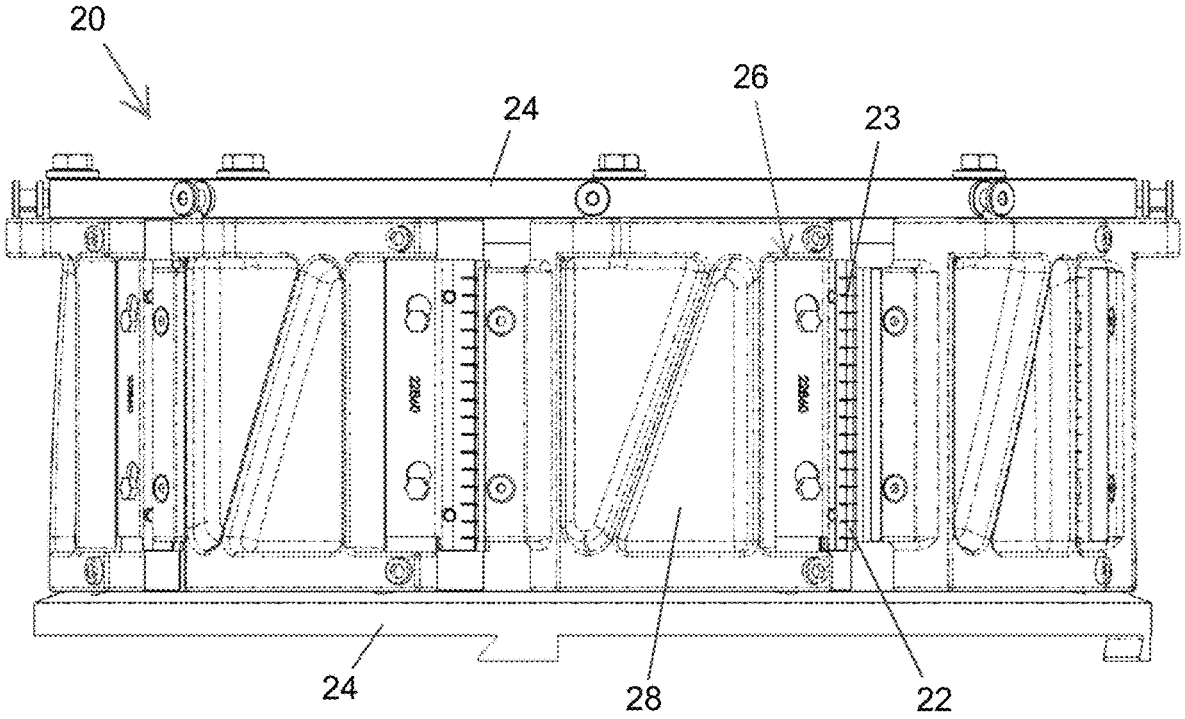
FIG. 3 (Prior Art)
FIG. 3 is a side view representing a cutting head of an existing Model CC® machine equipped with knife assemblies that are adapted for producing flat strip-cut food products.

The present invention provides knife assemblies and methods therefor that may be used with various types of equipment for slicing, shredding and granulating food products, such as vegetable, fruit, dairy, and meat products. Although the knife assemblies and methods are described hereinafter in reference to DiversaCut 2110® and Urschel Model CC® machines, both of which are centrifugal-type cutting apparatuses equipped with a rotating impeller within a stationary annular-shaped cutting head, for example, similar to what is represented in FIGS. 1 through 3, it will be appreciated that the knife assemblies and methods are generally applicable to other types of equipment, such as, but not limited to, other types of centrifugal-type cutting apparatuses that are capable of producing uniform slices, strip cuts, shreds, and/or granulations of a wide variety of products, including but not limited to food products. The present invention is particularly suitable for producing relatively thick strip-cut food products.

Figure 4:
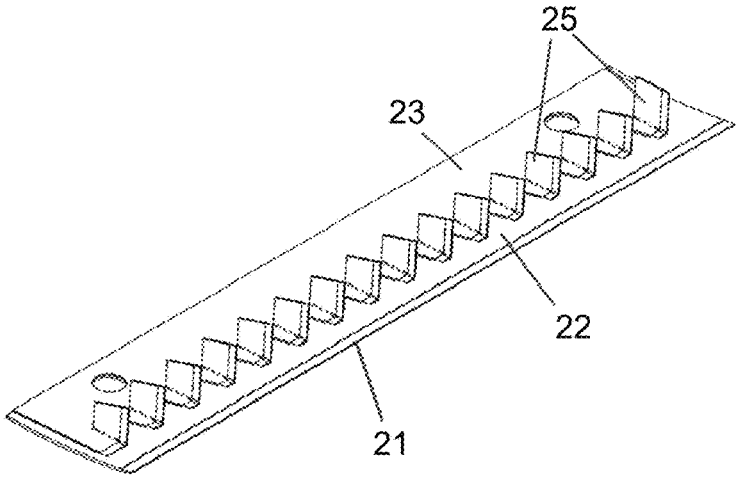
FIG. 4 (Prior Art)
FIG. 4 is an isolated view representing a pair of knives of a type used with each knife assembly of FIG. 3 to produce strip-cut flat food products.
Figure 5:
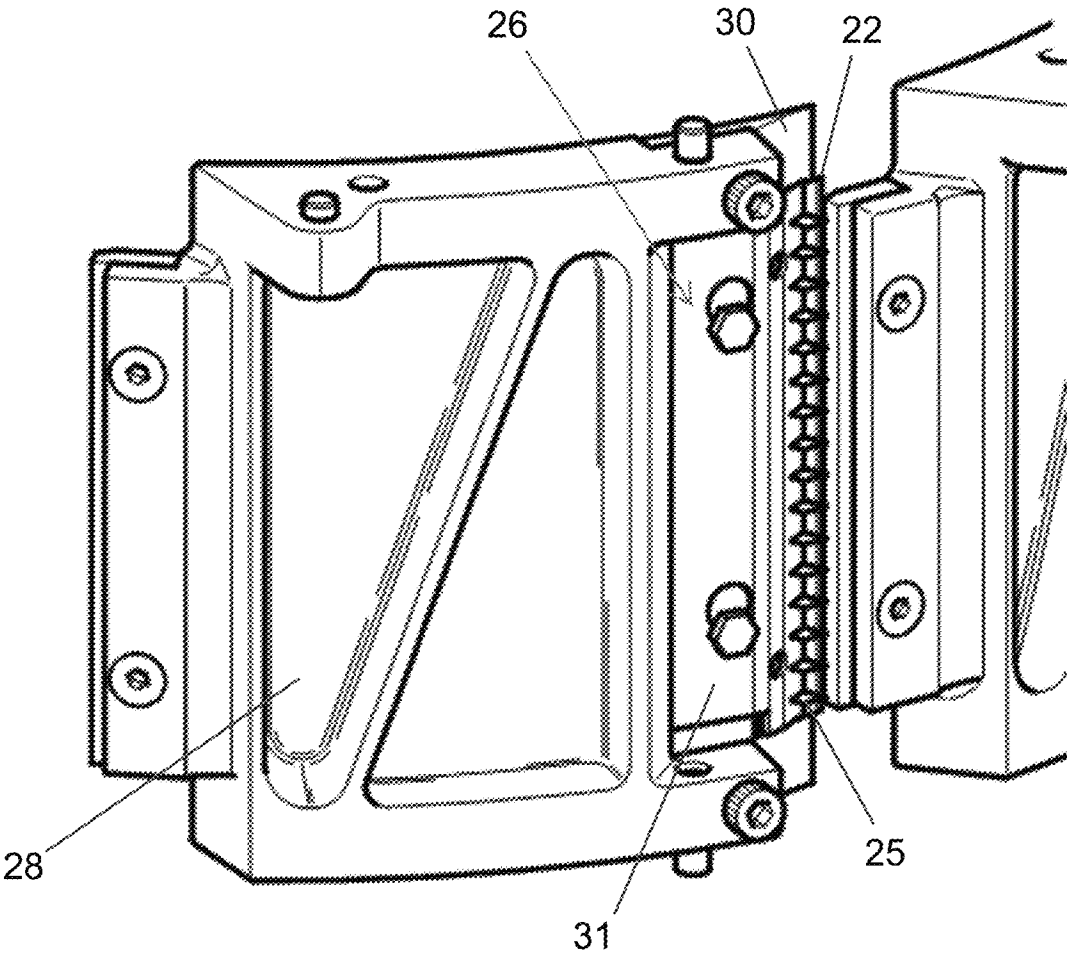
FIG. 5 (Prior Art)
FIG. 5 is an isolated perspective view representing a shoe and corresponding knife assembly of FIG. 3.

To facilitate the description provided below of the embodiment represented in the drawings, relative terms, including but not limited to, "lateral," "front," "rear," "side," "forward," "rearward," "upper," "lower," "above," "below," "right," "left," etc., may be used in reference to the orientation of a knife assembly as it would be mounted in a cutting head, for example, similar to those represented in FIGS. 4 and 5. Furthermore, on the basis of an axial arrangement of the impeller and cutting head, relative terms including but not limited to "axial," "circumferential," "radial," etc., and related forms thereof may also be used below to describe the nonlimiting embodiments represented in the drawings. For example, a "radial" or a "radial direction" refers to a ray extending perpendicularly from an axis of rotation (A in FIG. 1) of the impeller within the cutting head toward the circumference of the cutting head. "Axial" refers a line along the axis of rotation of the impeller within the cutting head. Therefore, a first component that is located radially outward from a second component indicates that the first component is farther from the axis of rotation (A) of the impeller along a radial direction than the second component.

Figure 6:
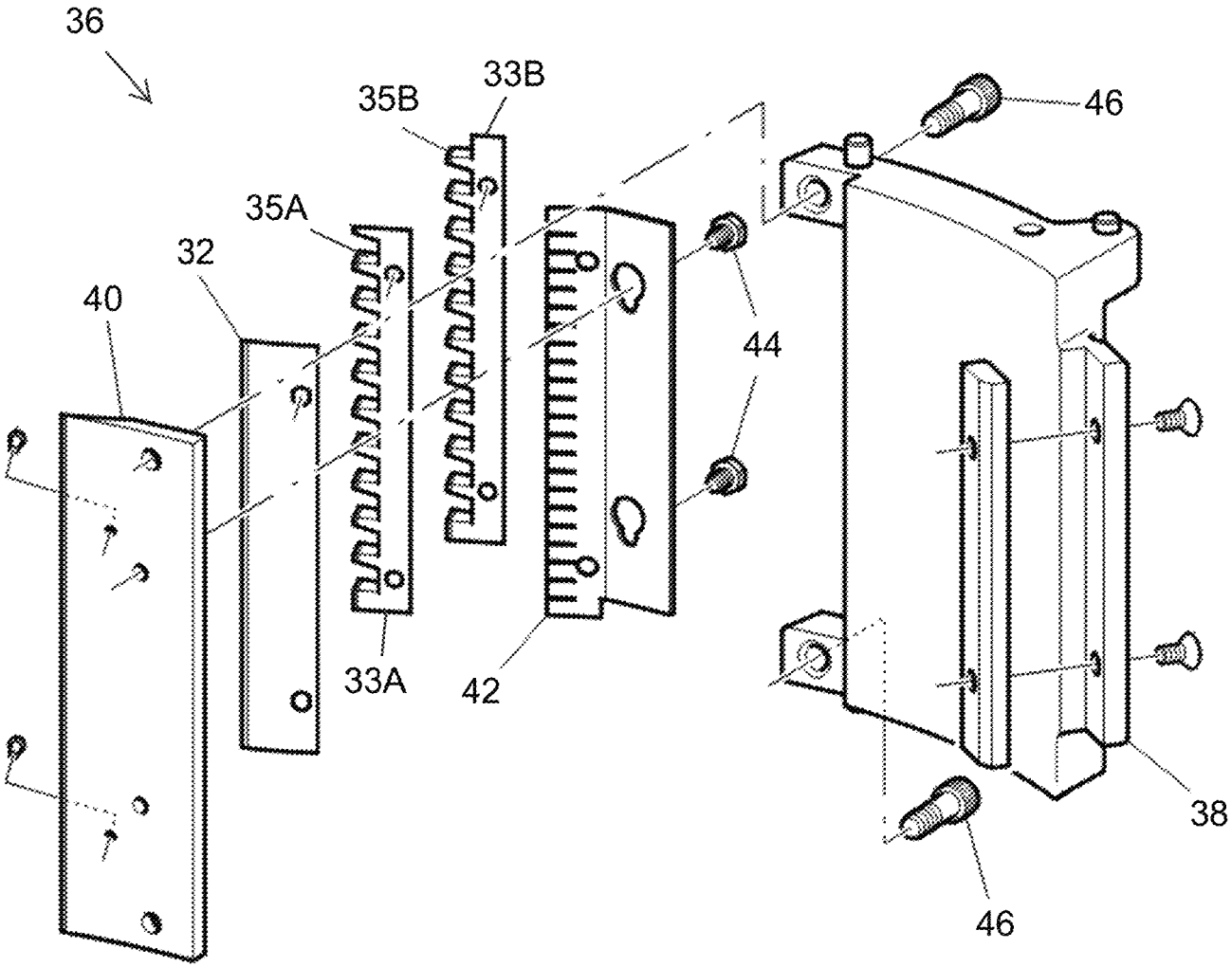
FIG. 6 (Prior Art)
FIG. 6 is an exploded view representing isolated components of a shoe and knife assembly of another type configured to be used in a cutting head of a Model CC® machine for producing flat strip-cut food products.

FIGS. 7 through 16 represent aspects of a nonlimiting knife assembly 136 configured for producing strip-cut (julienne-cut) food products using a centrifugal-type cutting apparatus such as the Model CC® machine. The knife assembly 136 includes a knife holder 140 and knife clamp 142 similar to, though not necessarily identical to, the knife holders and clamps of FIGS. 5 and 6. For example, the knife holder 140 may be configured to be secured to a shoe (not shown) in substantially the same manner as the knife holder 40 and shoe 38 of FIG. 6.

Figure 10:
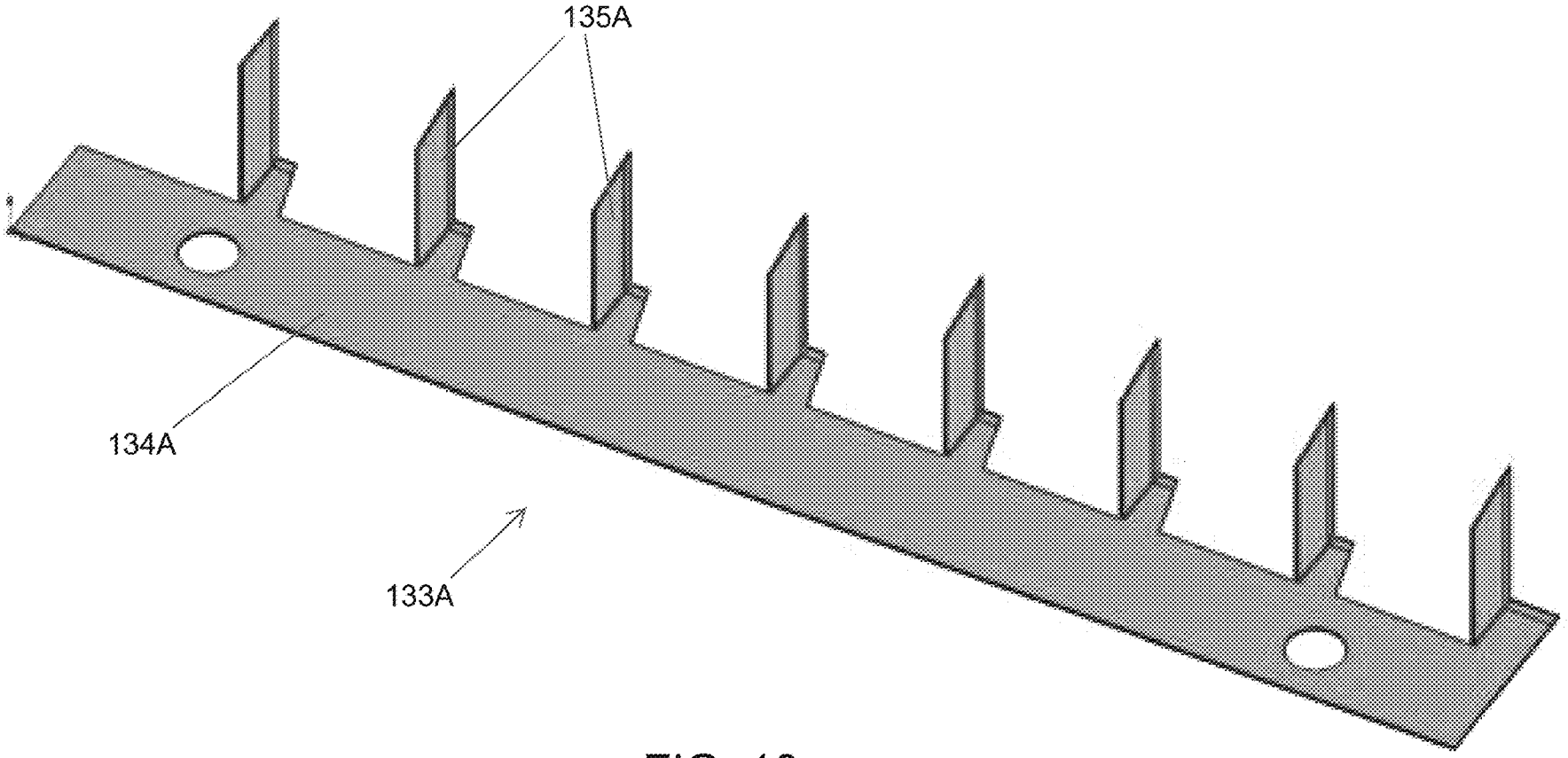
FIG. 10 is an isolated view representing one of a pair of strip knives of the knife assembly of FIGS. 7 through 9.
Figure 12:
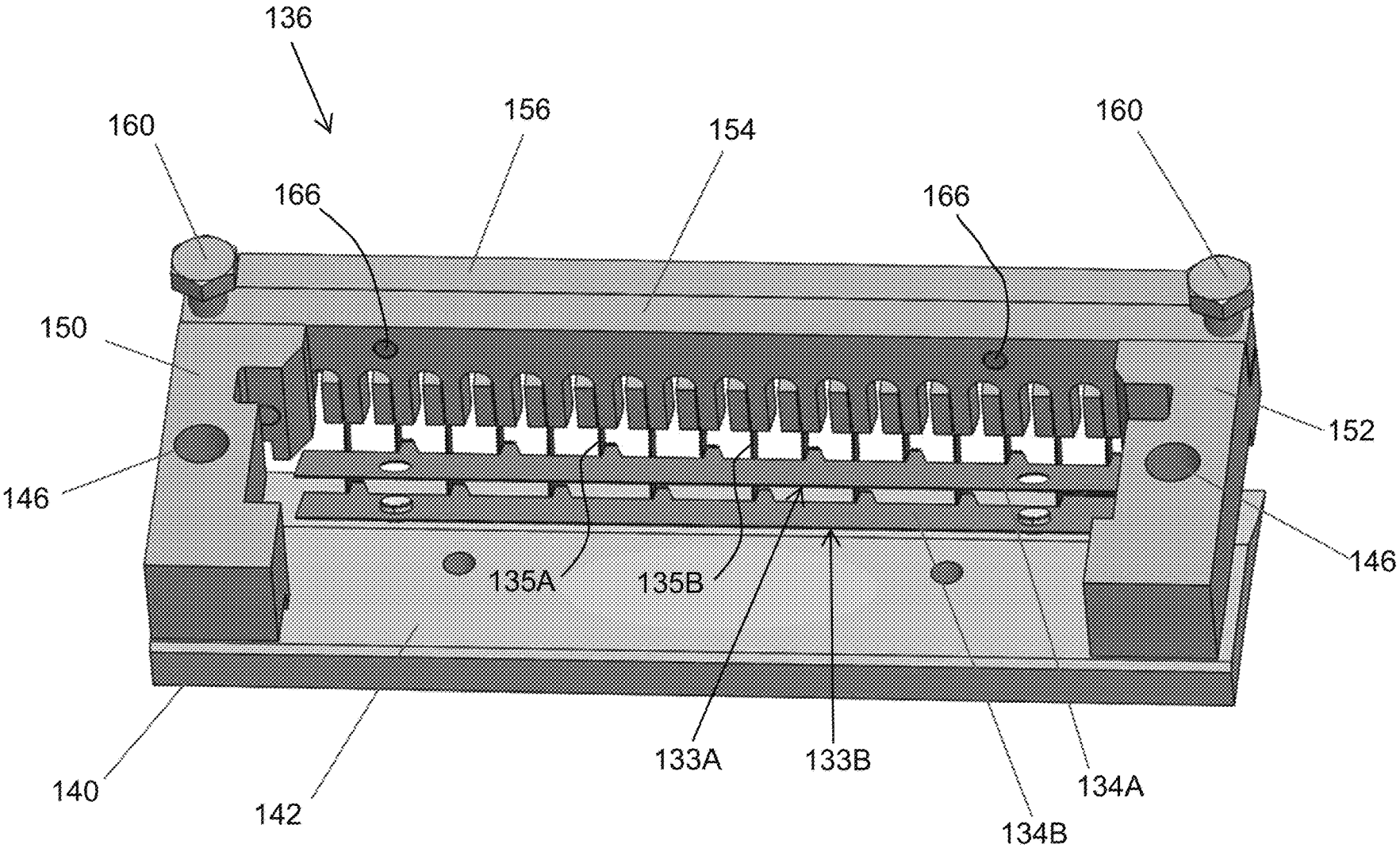
FIG. 12 is a perspective rear views representing certain members of the knife assembly of FIGS. 7 through 8 for purposes of illustrating the arrangement of the pair of strip knives of the knife assembly.

The knife clamp 142 is coupled with the knife holder 140, for example, with bolts (not shown) inserted in complementary holes 144 (FIG. 7) in the holder 140 and clamp 142, so that the clamp 142 is able to clamp a flat slicing knife 132 (FIG. 8) and a pair of strip knives 133A and 133B (FIG. 12). In the nonlimiting embodiment shown, the strip knives 133A and 133B are positioned on top of the slicing knife 132 (FIGS. 8 and 9) so as to be between the slicing knife 132 and the knife clamp 142. The strip knife 133A, which is positioned on top of the other strip knife 133B in FIG. 12, is shown in isolation in FIG. 10. The slicing knife 132 and strip knives 133A and 133B may be similar to, though not necessarily identical to, the slicing knife 32 and strip knives 33A and 33B of FIG. 6. Each strip knife 133A and 133B has blades or tabs 135A and 135B, respectively, that protrude substantially perpendicular to the generally flat or planar base 134A and 134B of the knife 133A/B (FIGS. 10 and 12). As such, the clamp 142 secures a proximal end of each tab 135A and 135B at a position adjacent to the slicing knife 132.

As evident from FIG. 12 (which omits the slicing knife 132 and knife clamp 142 for illustrative purposes), the strip knives 133A and 133B are assembled so that their tabs 135A and 135B alternate along the longitudinal length of the slicing knife 132. Alternatively, the slicing knife 132 could be assembled with only one of the strip knives 133A or 133B, in which case the resulting assembly may be similar to, though not necessarily identical to, the slicing knife 22 and strip knife 23 of FIGS. 3 through 5. The knife clamp 142 includes a plurality of slots 143 (FIGS. 7 and 8) in a leading edge thereof that provide openings through which the tabs 135A and 135B extend. In operation, a cutting edge 131 of the flat slicing knife 132 cuts a slice of the food product, after which the tabs 135A and 135B of the strip knives 133A and 133B cut the slice into strips.

As tab length (height) increases (i.e., the dimension of a tab 135A/B from the base 134A/B of the strip knife 133A/B to the outermost edge at a distal end of the tab 135A/B oppositely disposed from the base 134A/B), there is an increased possibility of flexing, bending, plastically deforming, and/or breaking during cutting operations. To address this possibility, the knife assembly 136 includes a tab support assembly configured to support and preferably apply tension to the tabs 135A and 135B. The tab support assembly includes a pair of mounting blocks 150 and 152 that may be secured to a shoe (for example, 18, 28, or 38 in FIGS. 2, 3, 5, and/or 6) such that ends of the mounting blocks 150 and 152 are cantilevered over and/or adjacent to the leading edge of the knife holder 140 and knife clamp 142. In such an embodiment, the mounting blocks 150 and 152 may be secured to the shoe with bolts that also secure the knife holder 140 to the shoe. For example, the bolts 46 represented in FIG. 6 can be inserted through holes 146 (FIGS. 7 and 8) in the blocks 150 and 152 and complementary holes in the shoe before being threaded into an aligned set of holes 148 (FIG. 8) in the knife holder 140. If appropriate or desired, alignment features, for example, positioning pins, can be incorporated into the tab support assembly to ensure its proper alignment with the knife assembly 136 and shoe.

The mounting blocks 150 and 152 are shown as supporting first and second support blocks 154 and 156. The front end of each mounting block 150 and 152 includes a lip or ledge 180 shaped to receive and support ends of the first support block 154. Guide screws 158 couple the first and second support blocks 154 and 156 to one another and to the mounting blocks 150 and 152. For reasons to be discussed in more detail below, the guide screws 158 pass through elongated holes 162 and 164 (FIG. 11) in the support blocks 154 and 156, respectively, which cause the support blocks 154 and 156 to translate in opposite directions if both are caused to move away from the ledges 180 of the mounting blocks 150 and 152.

Figure 7:
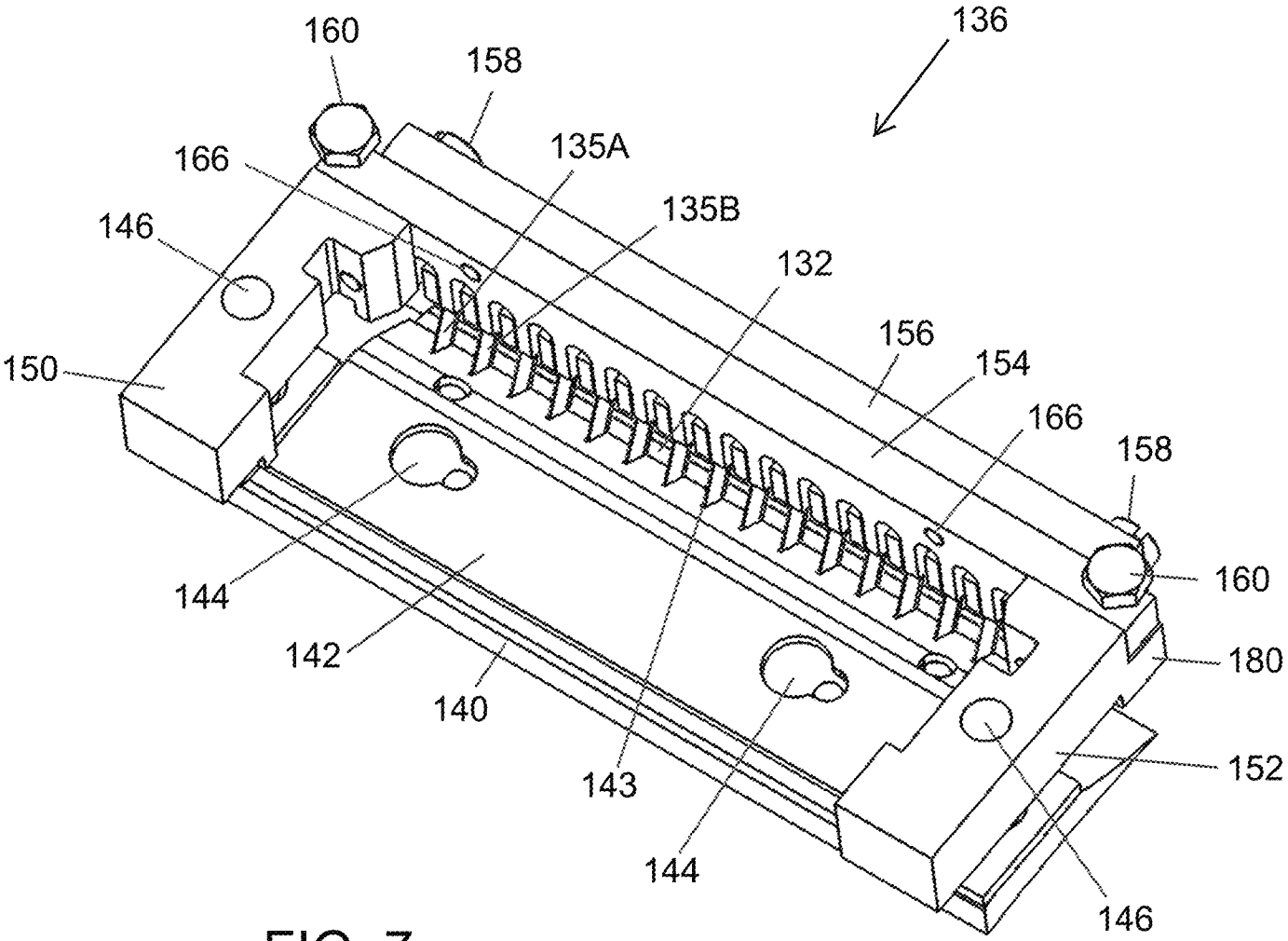
FIGS. 7 and 8 are perspective rear and front views, respectively, representing a nonlimiting knife assembly comprising a tab support assembly and configured for use with a centrifugal-type cutting apparatus in accordance with certain aspects of the present invention.
Figure 8:
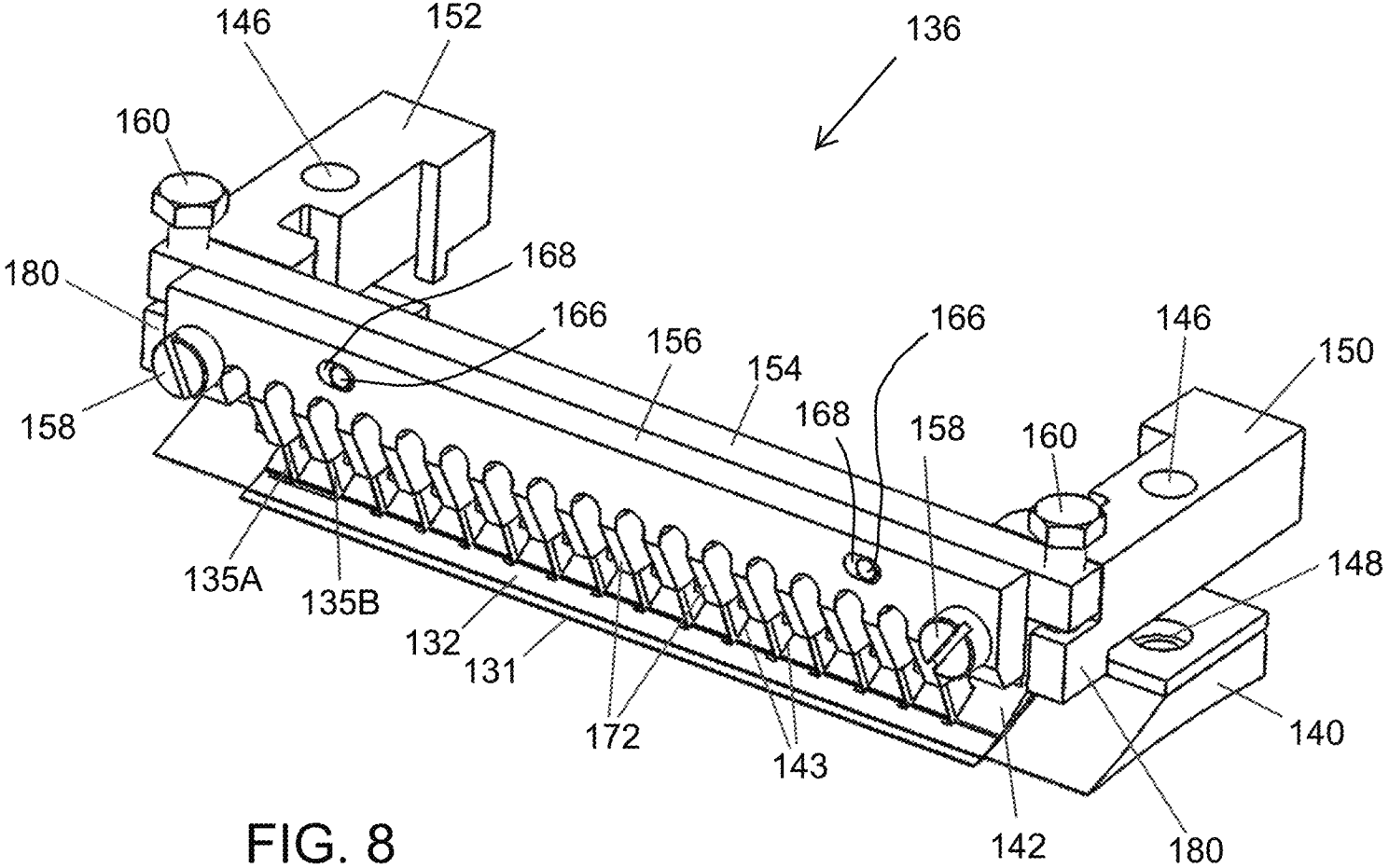
Figure 9:
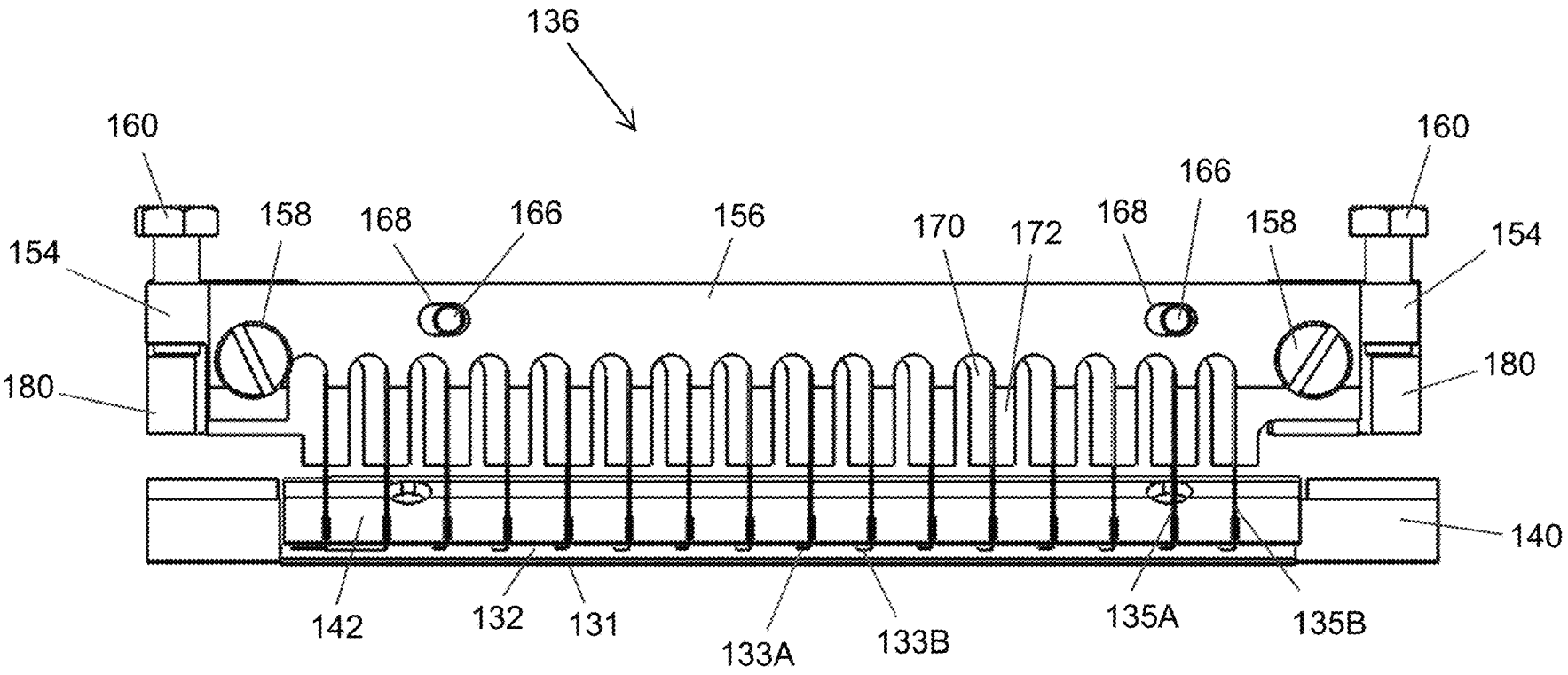
FIG. 9 is a front view of the knife assembly of FIGS. 7 and 8.

The first and second support blocks 154 and 156 include a plurality of fingers 170 and 172, respectively, configured for clamping individual tabs 135A and 135B therebetween. As most readily apparent from FIGS. 9, 11, 13, and 14, the fingers 170 and 172 are interdigitated, parallel to each other, and oriented to extend in-line with the tabs 135A and 135B when assembled, that is, the fingers 170 and 172 have parallel opposing surface that are parallel with the tabs 135A and 135B. When the first and second support blocks 154 and 156 are oriented face-to-face (e.g., the front face of the first support block 154 contacting the rear face of the second support block 156), trailing or rear portions of the fingers 172 of the second support block 156 extend beneath the first support block 154 and between the fingers 170 of the first support block 154 such that the trailing or rear ends of the fingers 170 and 172 are substantially aligned along the trailing or rear ends of the first support block 154, as shown in FIGS. 7 and 12. The entire top of each individual tab 135A and 135B (i.e., from the leading edge of the tab 135A/B to the trailing edge thereof) is preferably between and contacted by an adjacent pair of the fingers 170 and 172 when clamped therebetween. The leading or front face of each finger 172 of the second support block 156 is shown to be chamfered in FIG. 8 to reduce the likelihood that the fingers 172 will interfere with a food slice product during a strip-cut operation.

Figure 13:
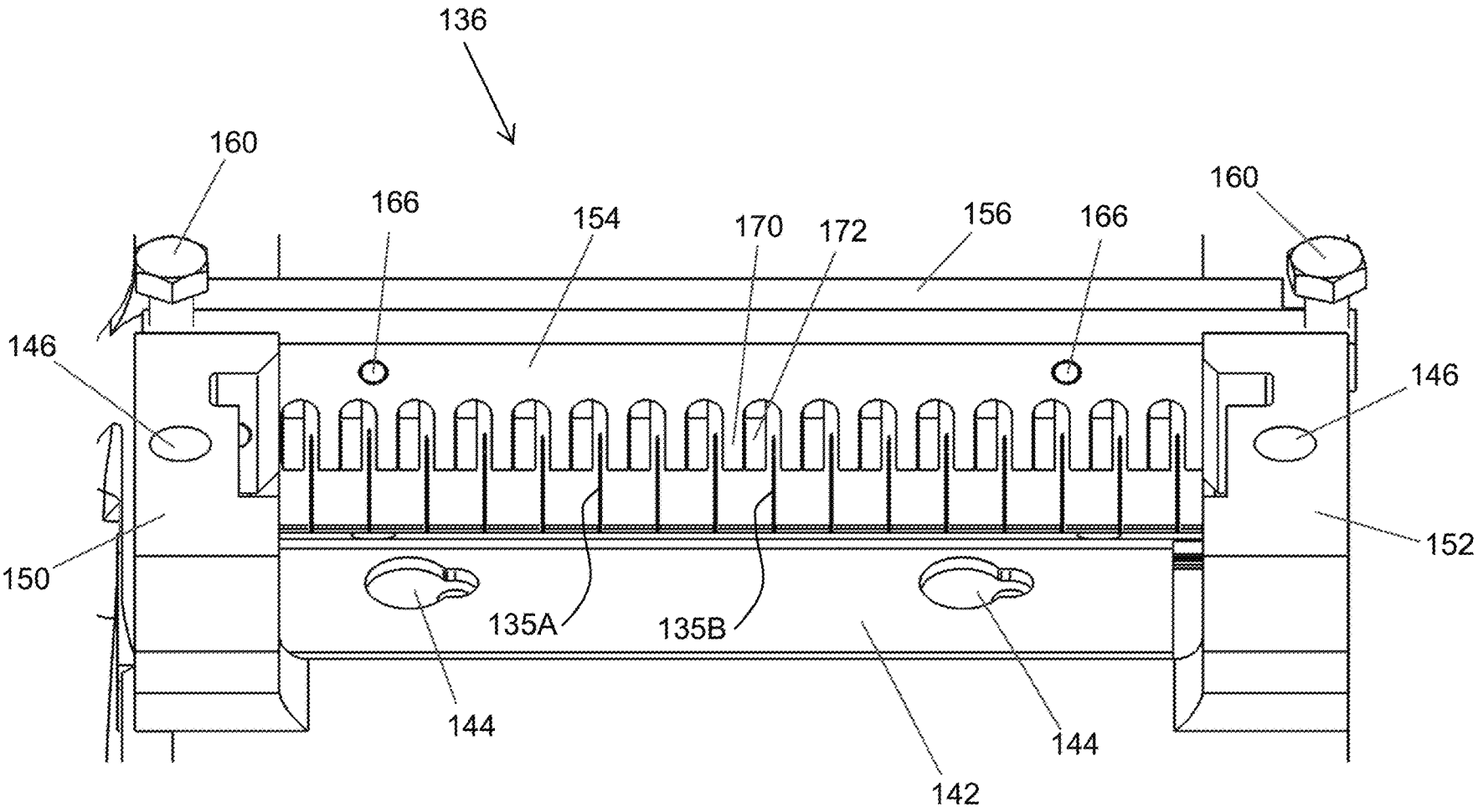
FIGS. 13 and 14 are rear views of the knife assembly of FIGS. 7 through 9 representing the support blocks in unclamped and clamped positions, respectively.
Figure 14:
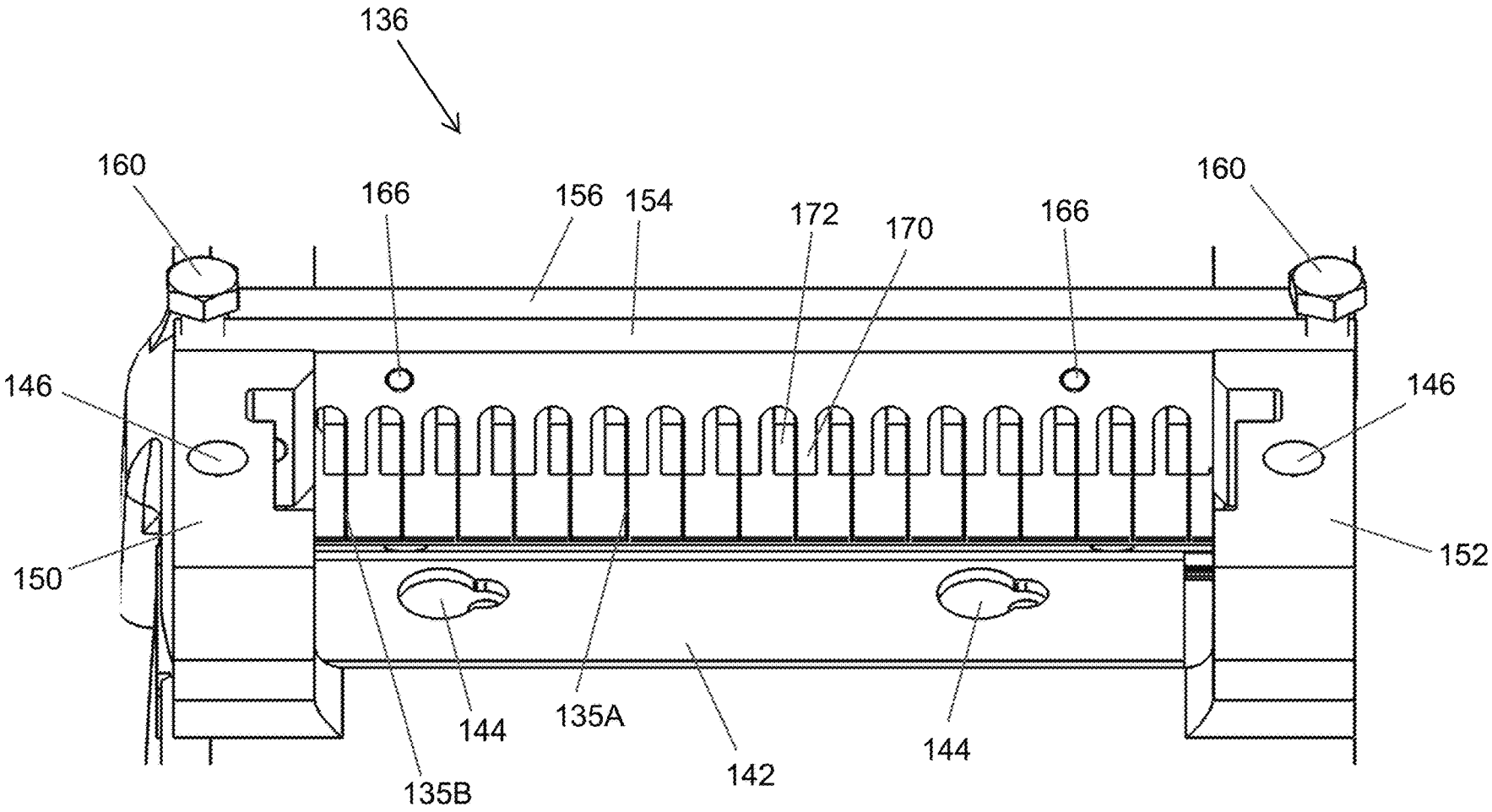

The first and second support blocks 154 and 156 preferably incorporate means for allowing the support blocks 154 and 156 to move relative to each other while maintaining a parallel alignment of the support blocks 154 and 156 and their fingers 170 and 172. In the nonlimiting embodiment shown in the drawings, the first support block 154 includes a pair of positioning pins 166 configured to be inserted into corresponding slots 168 in the second support block 156, such that movements of the support blocks 154 relative to each other are permitted in their longitudinal directions. The slots 168 in the second support block 156 provide sufficient longitudinal space for the positioning pins 166 of the first support block 154 to allow sufficient longitudinal travel of the support blocks 154 and 156 relative to each other that will enable their respective fingers 170 and 172 to fully release and securely clamp individual tabs 135A and 135B therebetween, as represented in FIGS. 13 and 14, respectively. The guide screws 158 serve to selectively permit and prevent relative movement of the first and second support blocks 154 and 156, such that relative movement of the support blocks 154 and 156 can be prevented once their fingers 170 and 172 securely clamp the tabs 135A and 135B of the strip knives 133A and 133B as shown in FIG. 14. In this clamping position, the fingers 170 and 172 are able to reduce the possibility that the tabs 135A and 135B will flex, bend, plastically deform, or break during slicing of a food product.

In order to further reduce the possibility of the tabs 135A and 135B flexing, bending, plastically deforming, and/or breaking, the support blocks 154 and 156 and their fingers 170 and 172 are also preferably operable to apply a tension force to the tabs 135A and 135B. To this end, tightening screws 160 are located on ends of the first support block 154 and are threaded into the first support block 154 such that ends of the tightening screws 160 may protrude from the first support block 154 and bear against the ledges 180 of the mounting blocks 150 and 152, as evident from FIGS. 8 and 9. Further threading of the tightening screws 160 into the first support block 154 increases the distance between the first support block 154 and the knife holder and clamp 140 and 142, thereby pulling the tabs 135A and 135B clamped between the fingers 170 and 172 and applying a tension force to the tabs 135A and 135B in a direction away from the base 134A and 134B of each strip knife 133A and 133B and along a longitudinal axis of each tab 135A and 135B.

Figure 11:
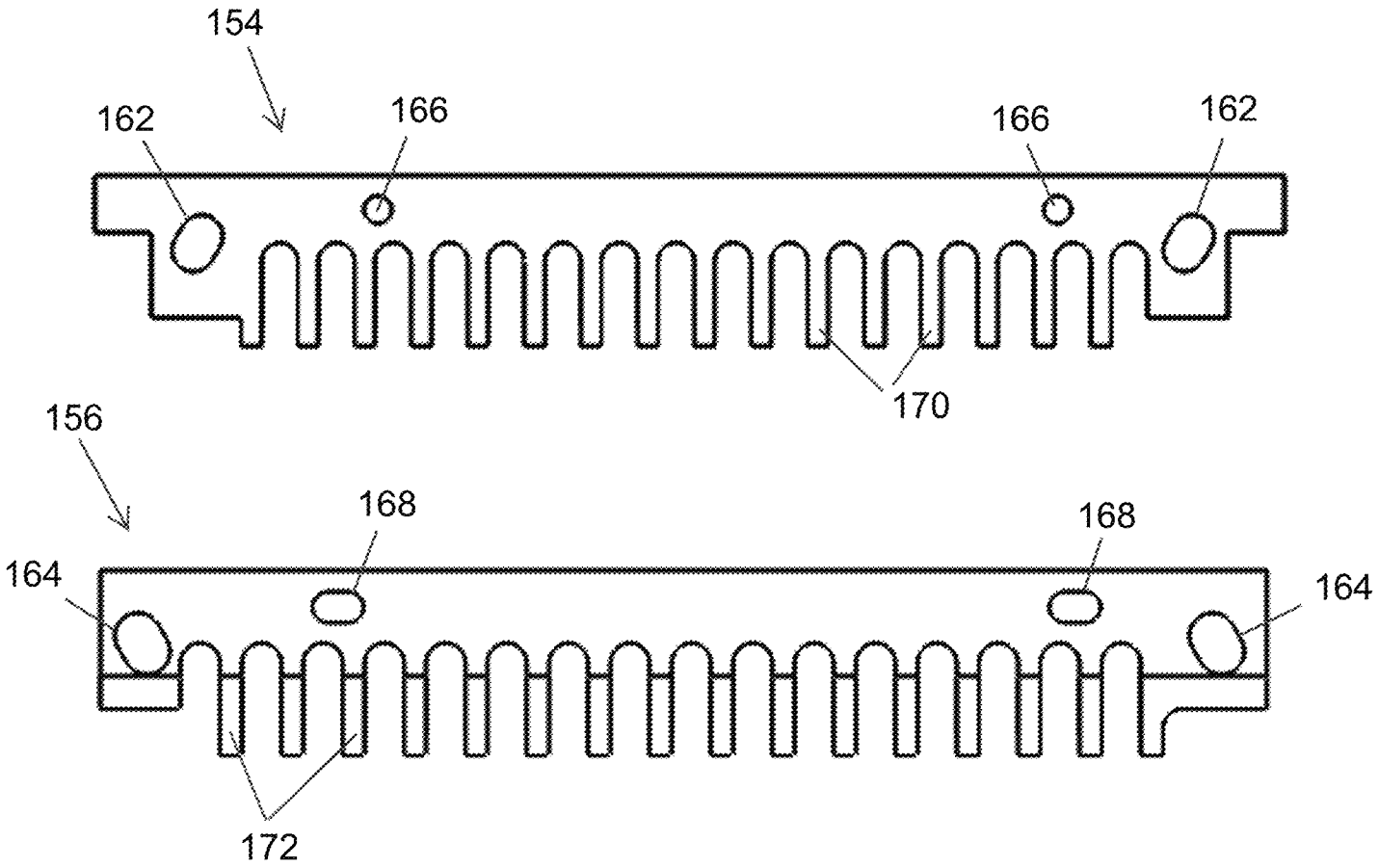
FIG. 11 contains front views of a pair of support blocks of the tab support assembly of FIGS. 7 through 9.

The elongated holes 162 and 164 of the first and second support blocks 154 and 156 are shown in FIG. 11 as inclined at opposite angles relative to the longitudinal directions of the support blocks 154 and 156. In the embodiment shown, the elongated holes 162 of the first support block 154 are oriented such that when the tightening screws 160 are threaded into the first support block 154 to lift the first support block 154 away from the knife holder 140, the profile or edges of its elongated holes 162 interact with the tightening screws 160 to cause the first support block 154 to move toward the tabs 135A and 135B that its fingers 170 are to contact, that is, to the right in the front views of FIGS. 9 and 11, and to the left in the rear views of FIGS. 13 and 14. In contrast, the elongated holes 164 of the second support block 156 are oriented such that as the support block 156 is lifted by the tightening screws 160 along with the first support block 154, the profile or edges of the elongated holes 164 interact with the tightening screws 160 to cause the second support block 156 to move toward the tabs 135A and 135B that its fingers 172 are to contact, that is, to the left in the front views of FIGS. 9 and 11, and to the right in the rear views of FIGS. 13 and 14. As such, the first and second support blocks 154 and 156 move longitudinally in opposite directions to each other while moving in unison away from the knife clamp 142 to simultaneously and gradually grip and tension the tabs 135A and 135B with their fingers 170 and 172.

Although the use of the tab support assembly is believed to be particularly beneficial for tabs having relatively large heights (lengths), it may be used with tabs having a wide range heights, and with various combinations of food product slice thicknesses (defined by a radial gap between the leading edge of the slicing knife and the trailing edge of a shoe circumferentially proceeding the slicing knife) and food product strip widths (defined by the distance between adjacent tabs 135A and 135B).

As nonlimiting examples, the first and second support blocks 154 and 156 may be configured to clamp tabs 135A and 135B having a spacing therebetween of about 0.25 inch (6.35 mm) or about 0.375 inch (9.525 mm). Such configurations could further grip strip knives 133A and 133B having tab spacings that are multiples thereof without any modifications to the support blocks 154 and 156. For example, a tab support assembly configured to hold tabs 135A and 135B having a tab spacing of about 0.25 inch (6.35 mm) could also hold strip knives 133A and 133B with tab spacings of about 0.5 inch (12.7 mm), about 0.75 inch (19.05 mm), and about 1.0 inch (25.4 mm), in which case some of pairs of fingers 170 and 172 would not have a tab 135A or 135B located therebetween. Similarly, a tab support assembly configured to hold tabs 135A and 135B having a tab spacing of about 0.375 inch (9.525 mm) could also grip strip knives 133A and 133B with tab spacings of about 0.75 inch (19.05 mm) and about 1.125 inches (28.575 mm). In practice, it may be sufficient that the tabs 135A and 135B have sufficient heights to produce strip-cut food products having thicknesses of between about 0.03 and 0.375 inch (0.762-9.525 mm).

Figure 15:
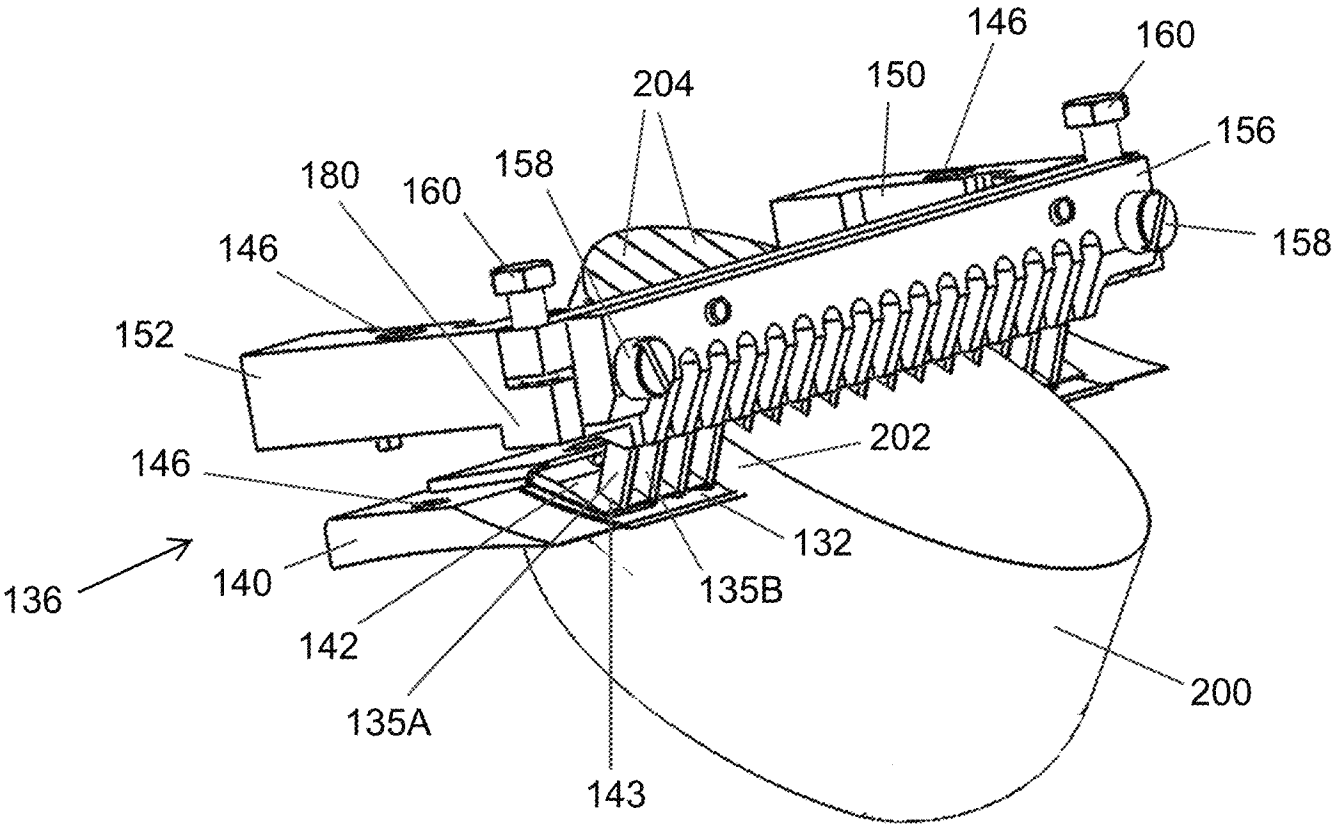
FIGS. 15 and 16 are perspective views representing the knife assembly of FIGS. 7 through 9 during a strip-cut operation of a food product.
Figure 16:
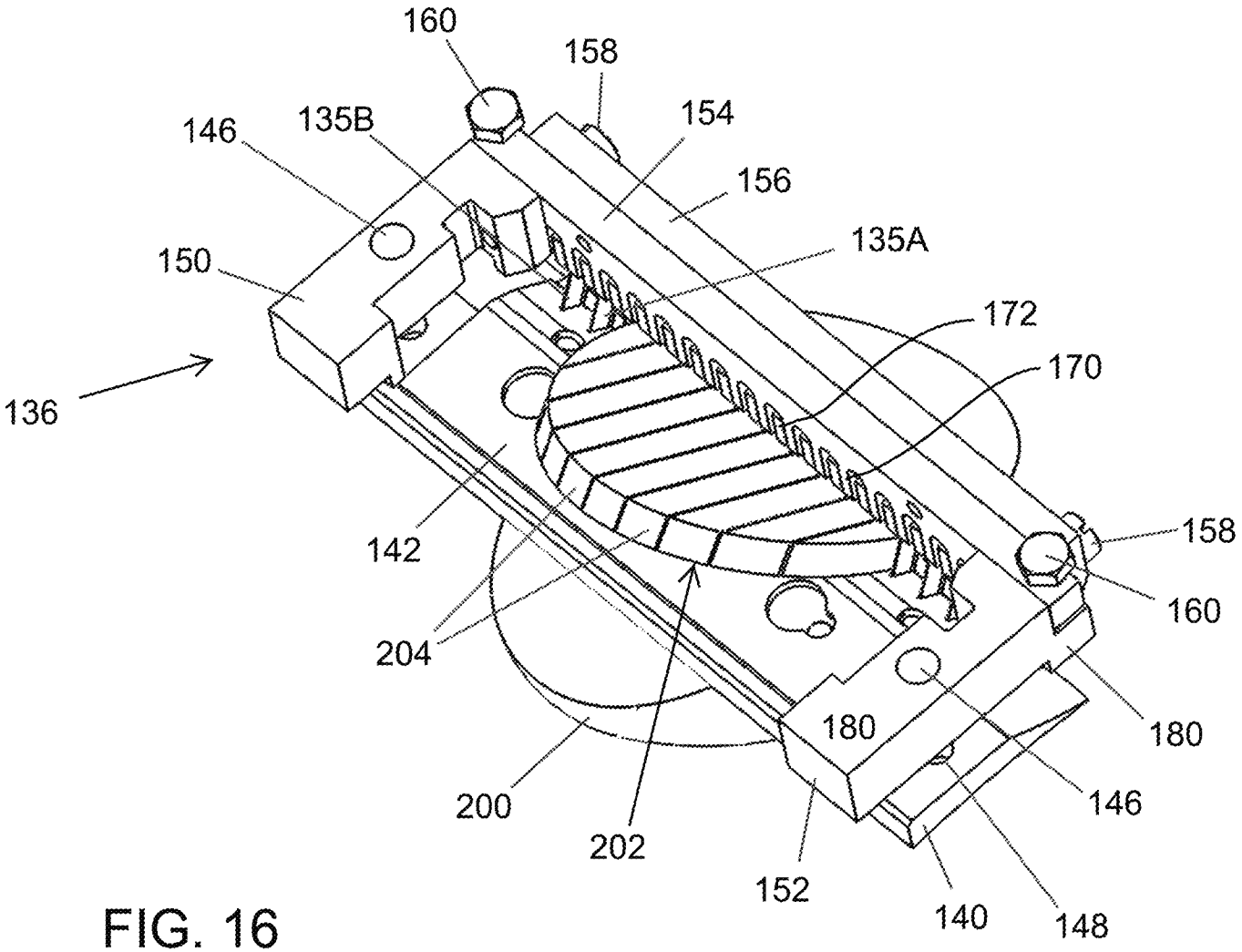

FIGS. 15 and 16 represent isolated perspective views of the knife assembly 136 during operation. A food product 200 (for example, a potato) located within a cutting head (not shown) is caused (for example, by an impeller such as represented in FIG. 1) to contact the knife assembly 136. As represented, the cutting edge 131 of the slicing knife 132 cuts the food product 200 to separate a slice product 202 therefrom. The leading edges of the tabs 135A and 135B of the strip knives 133A and 133B, respectively, then cut the slice product 202 into individual strips 204.

While the knives and methods are described above in reference to flat (planar) slicing knives, it will be apparent to those skilled in the art that the teachings disclosed herein are applicable to other types of slicing knives, such as corrugated slicing knives. Furthermore, while the strip knives 133A and 133B disclosed herein are represented as being formed by cutting the body of the knives 133A and 133B to define the tabs 135A and 135B, which are then bent to be substantially perpendicular to the remainder (base 134A and 134B) of each knife 133A and 133B, it will be apparent to those skilled in the art that other types of strip knives could be used. For example, the flat slicing knife 132 and the pair of strip knives 133A and 133B could be replaced with a slicing knife having a plurality of tabs metallurgically joined to a surface thereof.

As evident from FIGS. 15 and 16, the knife assembly 136 is adapted to produce a two-dimensional cut in the product 200 with the slicing knife 132, and then additional two-dimensional cuts in the resulting slice product 202 with the tabs 135A and 135B of the strip knives 133A and 133B. Because these two-dimensional cuts can be produced with a single moving component (an impeller, such as represented in FIG. 1), a knife assembly within the scope of this invention can be configured to produce any or all of the two-dimensional cuts to produce slices or strips having a desired shape, such as corrugated surfaces on the four sides of each strip 204 produced by the slicing knife 132 and tabs 135A and 135B. As the strips 204 exit the knife assembly 136, an additional two-dimensional cut can be further made in each strip 204 with a cross-cut assembly, such as of the type used with the DiversaCut 2110® machine, to produce a diced product. The cross-cut assembly may carry flat or shaped knives that produce two-dimensional cuts that are transverse to the cuts made by the slicing knife 132 and tabs 135A and 135B. In the case where a shaped knife is used to produce the transverse cuts, a diced product can be produced in which all six sides of each product have corrugated or otherwise shaped surfaces.

FIGS. 17 through 22 depict additional configurations of knife assemblies in accordance with further embodiments of this invention. In these figures, consistent reference numbers are used to identify the same or functionally equivalent elements, but with a numerical prefix (2) added to distinguish the particular embodiment from the embodiment of FIGS. 7 through 16. In view of similarities between the embodiments, the following discussion of FIGS. 17 through 22 will focus primarily on aspects of the further embodiments that differ from the first embodiment in some notable or significant manner. Other aspects of the further embodiments not discussed in any detail can be, in terms of structure, function, materials, etc., essentially as was described for the first embodiment.

FIGS. 17 through 22 represent aspects of another nonlimiting knife assembly 236 configured for producing strip-cut (julienne-cut) food products using a centrifugal-type cutting apparatus 210 such as the DiversaCut 2110® machine. Similar to the knife assembly 136 of FIGS. 7 through 16, the knife assembly 236 includes a slicing knife 232 secured to a knife holder 240 with a knife clamp 242. The slicing knife 232 is configured as a corrugated slicing knife instead of the flat (planar) slicing knife 132 of the previous embodiment. The clamp 242 further secures a strip knife 233 having blades or tabs 235 that extend substantially perpendicular to a generally flat or planar base 234 of the strip knife 233. As such, the clamp 242 secures a proximal end of each tab 235 at a position adjacent the slicing knife 232. Notably, the slicing knife 232 and tabs 235 depicted in FIGS. 17 through 22 are shaped to produce shaped (corrugated) two-dimensional cuts in a product, such that four sides of each strip produced by the knife assembly 236 have corrugated surfaces.

The knife assembly 236 includes a tab support assembly configured to support and optionally apply tension to the tabs 235 of the strip knife 233 in a direction away from the base 234 of the strip knife 233 and along a longitudinal axis of each tab 235. The tab support assembly includes a pair of mounting blocks 250 and 252 that may be secured to the machine 210, such that ends of the mounting blocks 250 and 252 are cantilevered over and/or adjacent to the leading edge of the slicing knife 232. For example, FIGS. 17 through 22 depict the mounting blocks 250 and 252 secured to the machine 210 with bolts 246.

The mounting blocks 250 and 252 support first and second support blocks 254 and 256, generally in the same manner as described for the embodiment of FIGS. 7 through 16. Also similar to the knife assembly 136 of FIGS. 7 through 16, the front ends of the mounting blocks 250 and 252 include a lip or ledge (not shown) shaped to receive and support ends of the first support block 254. Guide screws 258 couple the first and second support blocks 254 and 256 to one another and to the mounting blocks 250 and 252, and pass through elongated holes (not shown) in the support blocks 254 and 256 configured so that the support blocks 254 and 256 translate in opposite longitudinal directions relative to each other as the blocks 254 and 256 are caused to move away from the ledges of the mounting blocks 250 and 252 through the action of tightening screws 260. In so doing, interdigitated fingers 270 and 272 of the support blocks 254 and 256 clamp distal ends of the tabs 235 therebetween, and serve to reduce the possibility that the tabs 135A and 135B will flex, bend, plastically deform, or break during slicing of a food product. The guide screws 258 also serve to selectively permit and prevent relative movement of the support blocks 254 and 256, such that relative movement of the support blocks 254 and 256 can be prevented once their fingers 270 and 272 securely clamp the tabs 235 of the strip knife 233 as shown in FIGS. 17 and 18.

Figure 17:
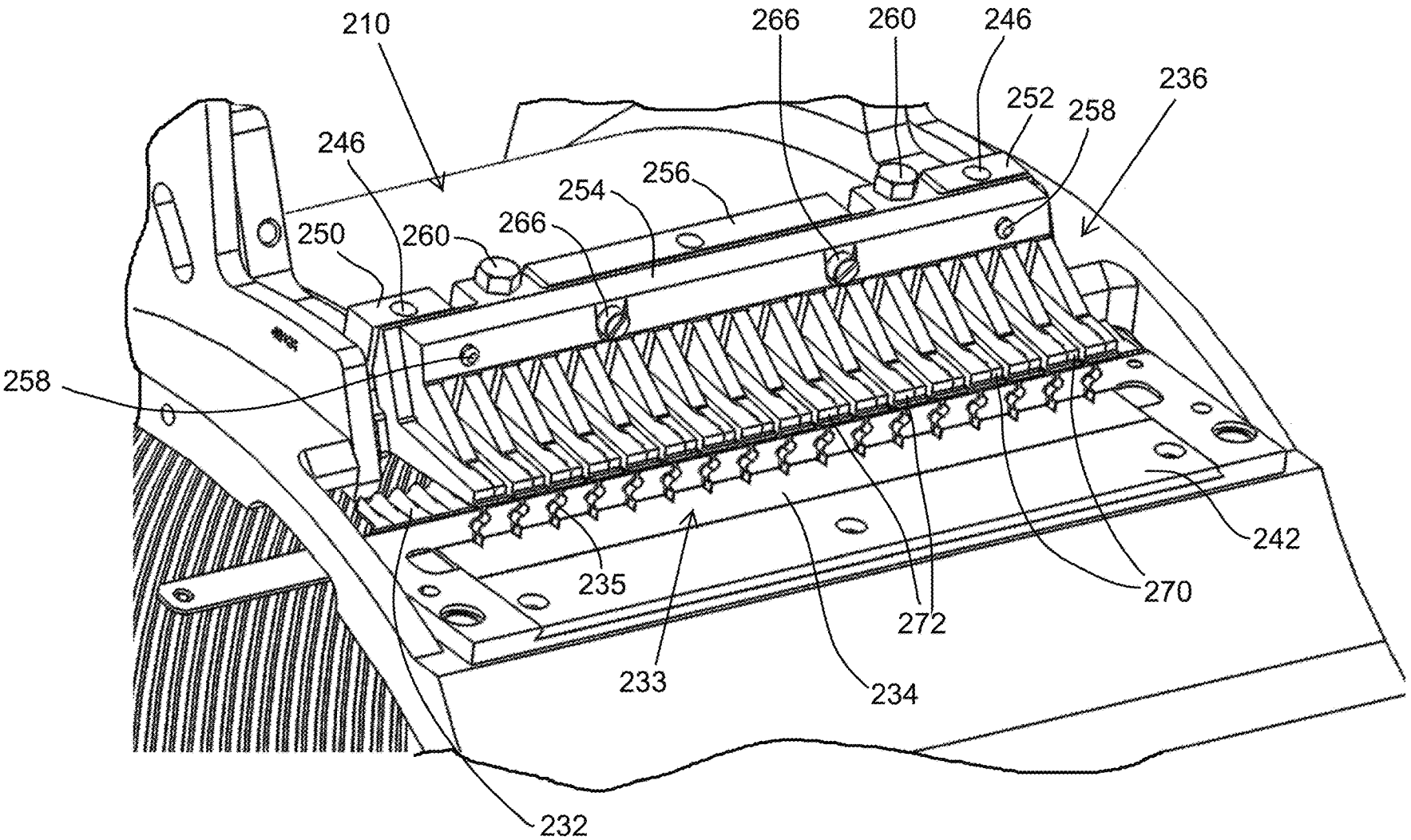
FIG. 17 represents a perspective view of another nonlimiting knife assembly comprising a tab support assembly and configured for use with a centrifugal-type cutting apparatus in accordance with certain aspects of the present invention.
Figure 18:
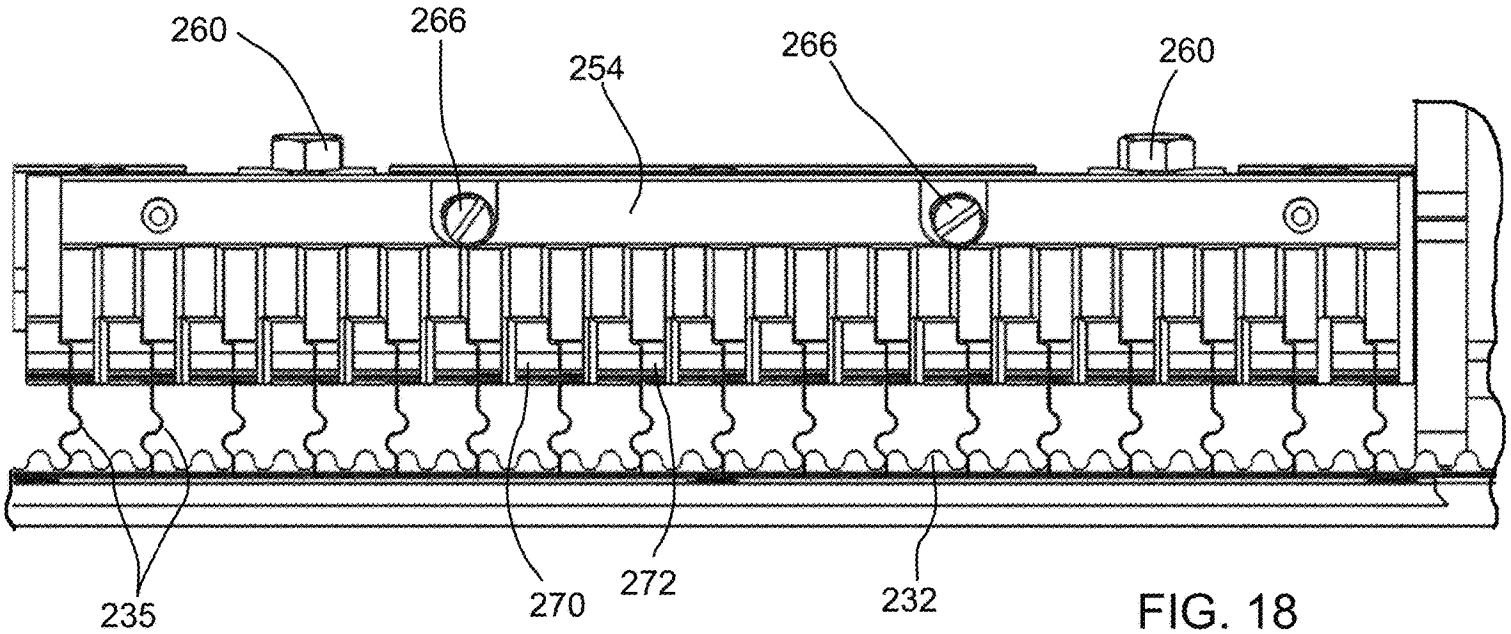
FIG. 18 is a front view of the knife assembly of FIG. 17.
Figure 19:
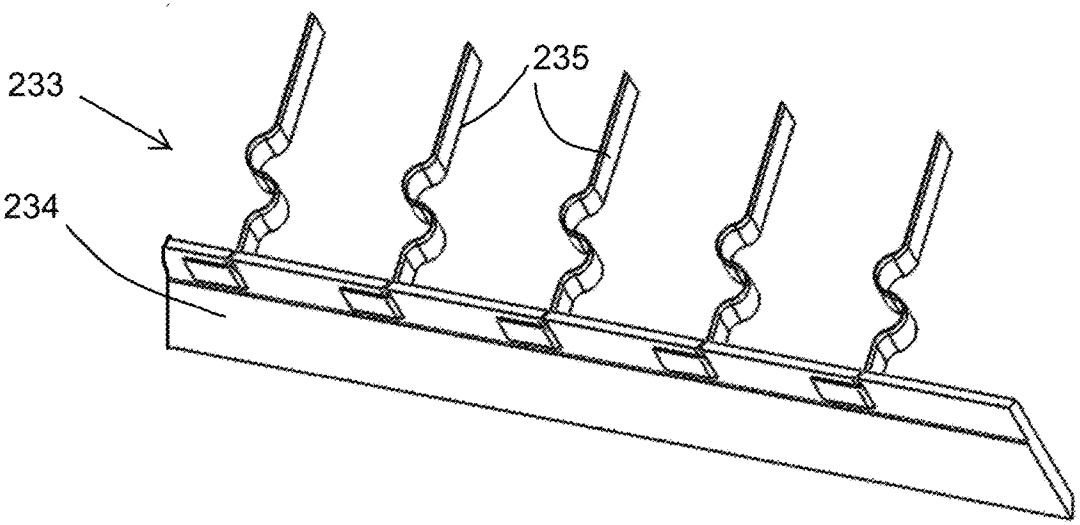
FIG. 19 is an isolated view representing a strip knife of the knife assembly of FIGS. 17 and 18.

As with the knife assembly 136 of FIGS. 7 through 16, the knife assembly 236 of FIG. 17 may be configured so that further threading of the tightening screws 260 into the first support block 254 is operable to increase the distance between the first support block 254 and the knife holder and clamp 240 and 242, thereby pulling the tabs 235 clamped between the fingers 270 and 272 and applying a tension force to the tabs 235. Positioning pins 266 threaded into the first support block 254 and through corresponding slots (not shown) in the second support block 256 permit the support blocks 254 and 256 to move relative to each other in their longitudinal directions as the fingers 270 and 272 to clamp the tabs 235, and then also ensure that the support blocks 254 and 256 are maintained in a parallel alignment while being raised in unison by the tightening bolts 260.

Figure 20:
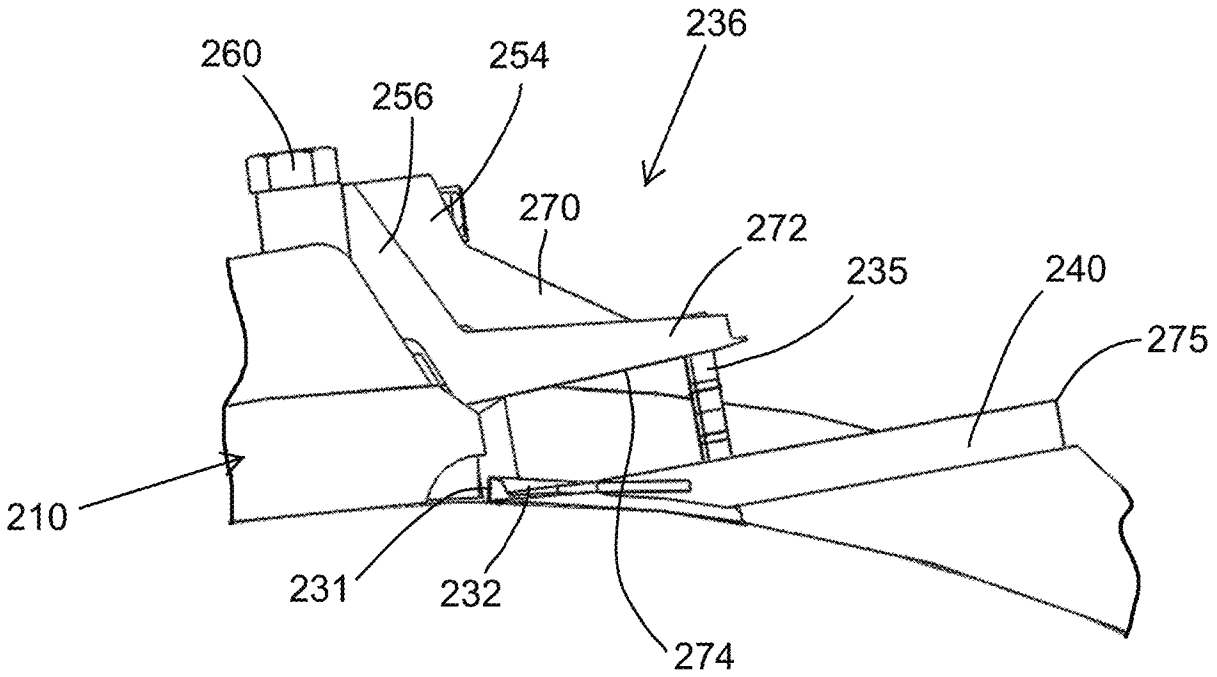
FIG. 20 is an end view of the knife assembly of FIG. 17.

FIG. 20 illustrates optional capabilities of the knife assembly 236 that are desirable if used in combination with a cross-cut assembly in a machine having a dicing capability, as a nonlimiting example, the DiversaCut 2110®. Strips exiting the knife assembly 236 can be stabilized as a result of the fingers 270 and 272 extending parallel to the slicing knife 232 and knife holder 240, from the cutting edge 231 of the knife 232 to (and beyond) the tabs 235. Lower surfaces 274 of the fingers 270 and 272 facing the slicing knife 232 effectively serve as a product guide for a slice as it exits the slicing knife 232 and prior to encountering the strip knife 233 and its tabs 235. The fingers 270 and 272 continuously prevent the slice from lifting away from the knife holder 240 as the slice engages the tabs 235, and also assist to keep the resulting strips against the surface of the knife holder 240 prior to encountering the knife of a cross-cut assembly. The knife assembly 236 is represented as being further configured so that the trailing edge 275 of the knife holder 240 can serve as a shear edge during the cross-cutting operation. As previously noted, the knife of the cross-cut assembly may be shaped so that all six sides of the resulting diced products have corrugated or otherwise shaped surfaces.

Figure 21:
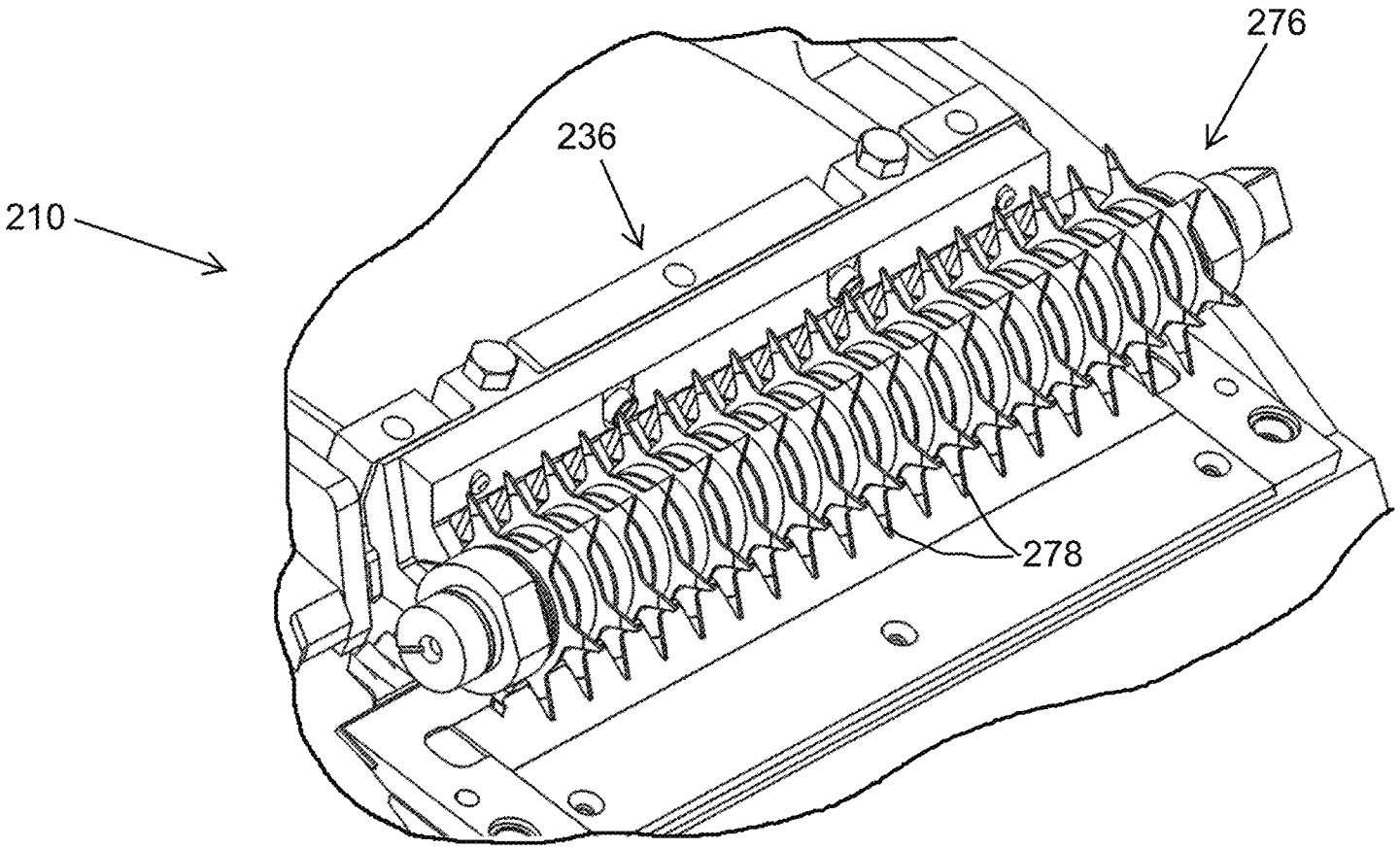
FIGS. 21 and 22 represent the knife assembly of FIG. 17 used in combination with feed disks adapted to move strip products from the knife assembly.
Figure 22:
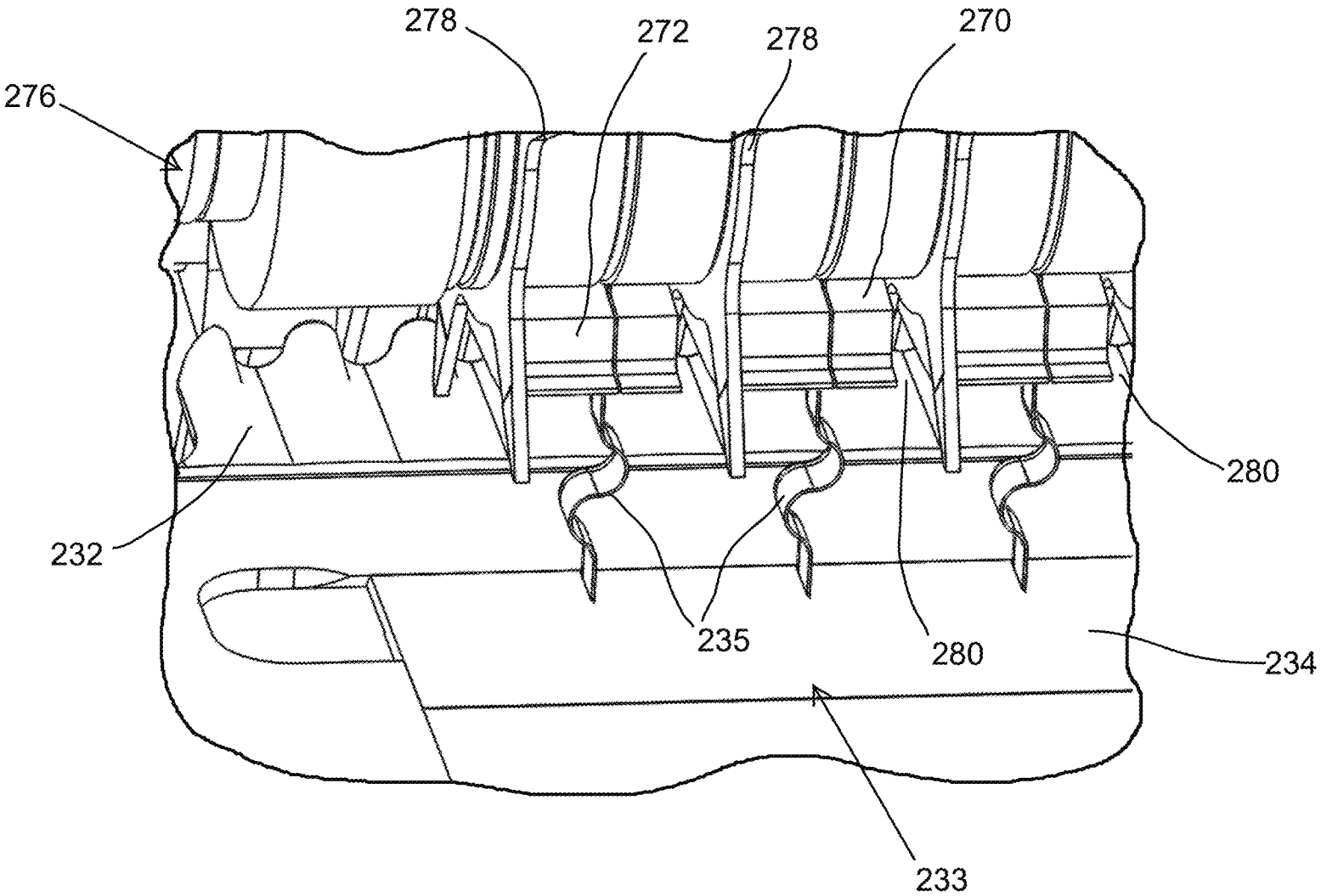

FIGS. 21 and 22 represent the knife assembly 236 of FIG. 17 used in further combination with rotating feed disks 276 adapted to assist in moving a slice produced by the slicing knife 232 through the tabs 235 of the strip knife 233 to produce strip-cut food products. As represented, individual radial legs 278 of the feed disks 276 pass through gaps or slots 280 defined between adjacent pairs of the fingers 270 and 272 cooperating to clamp a tab 235 therebetween, such that each leg 278 engages a portion of a slice moving between adjacent pairs of the tabs 235.

While the invention has been described in terms of particular embodiments, it should be apparent that alternatives could be adopted by one skilled in the art. For example, the knife assemblies 136 and 236 and their components could differ in appearance and construction from the embodiments described herein and shown in the drawings, functions of certain components of the knife assemblies 136 and 236 could be performed by components of different construction but capable of a similar (though not necessarily equivalent) function, various materials could be used in the fabrication of the knife assemblies 136 and 236 and/or their components, and the knife assemblies 136 and 236 could be used in a variety of different cutting apparatuses and for the purpose of cutting various types of materials. Accordingly, it should be understood that the invention is not necessarily limited to any embodiment described herein or illustrated in the drawings. It should also be understood that the phraseology and terminology employed above are for the purpose of describing the disclosed embodiments, and do not necessarily serve as limitations to the scope of the invention. Therefore, the scope of the invention is to be limited only by the following claims.

The invention claimed is:

1. A knife assembly adapted for cutting a product, the knife assembly comprising:

a slicing knife having a cutting leading edge and configured to produce a slice product from the product;

a tab that extends outward from the slicing knife and is configured to cut the slice product into a strip-cut product, the tab having a longitudinal axis and a distal end;

a knife holder for securing the slicing knife and fixing a proximal end of the tab to a position adjacent to the slicing knife; and a tab support assembly configured to clamp onto a distal end of the tab, the tab support assembly comprising:

first and second support blocks, the first support block having a first finger and a first elongated hole, the second support block having a second finger and a second elongated hole;

means for lifting the first and second support blocks away from the knife holder in a direction along the longitudinal axis of the tab; and guide screws coupling the first and second support blocks together and passing through the first and second elongated holes of the first and second support blocks, the first and second elongated holes having profiles so that, due to interactions between the guide screws and the profiles of the first and second elongated holes, as the first and second support blocks are lifted away from the knife holder the first and second support blocks translate in opposite directions and the first and second fingers move toward each other so that the first and second fingers simultaneously clamp the tab and apply tension to the tab.

2. The knife assembly of claim 1, wherein knife assembly comprises a plurality of the tab, the first support block has a plurality of the first finger, the second support block has a plurality of the second finger that are interdigitated with the first fingers of the first support block, and the first and second fingers are paired so that each pair of the first and second fingers is configured to clamp therebetween a distal end of a corresponding one of the tabs.

3. The knife assembly of claim 2, wherein the slicing knife and the tabs each produce a two-dimensional cut and the strip-cut product has four sides each having a shaped surface that is not flat.

4. The knife assembly of claim 1, further comprising a positioning pin on one of the first and second support blocks and a corresponding slot on the other of the first and second support blocks, wherein the corresponding slot is elongated such that when the positioning pin in located in the corresponding slot at least one of the first and second support blocks slides along a longitudinal axis thereof relative to the other of the first and second support blocks as the first and second support blocks translate in the opposite directions.

5. The knife assembly of claim 1, further comprising means for releasably securing the knife holder and the tab support assembly together and to a cutting head of a cutting apparatus.

6. A cutting apparatus comprising:

a cutting head having at least one knife assembly located at a circumference of the cutting head;

an impeller comprising paddles and configured to rotate within the cutting head such that products are contacted with the paddles and directed radially outward toward the knife assembly at the circumference of the cutting head, wherein radial directions extend perpendicularly from an axis of rotation of the impeller toward the circumference of the cutting head;

wherein the knife assembly comprises:

a slicing knife having a cutting leading edge and configured to produce a slice product from a product;

a tab that extends outward from the slicing knife and is configured to cut the slice product into a strip-cut product;

a knife holder for securing the slicing knife and fixing a proximal end of the tab to a position adjacent to the slicing knife; and a tab support assembly positioned radially outward from the knife holder and configured to clamp onto a distal end of the tab and pull the tab away from the knife holder along a longitudinal axis of the tab to apply tension to the tab, the tab support assembly comprising:

first and second support blocks, the first support block having a first finger and a first elongated hole, the second support block having a second finger and a second elongated hole;

means for lifting the first and second support blocks away from the knife holder in a direction along the longitudinal axis of the tab; and guide screws coupling the first and second support blocks together and passing through the first and second elongated holes of the first and second support blocks, the first and second elongated holes having profiles so that, due to interactions between the guide screws and the profiles of the first and second elongated holes, as the first and second support blocks are lifted away from the knife holder the first and second support blocks translate in opposite directions and the first and second fingers move toward each other so that the first and second fingers simultaneously clamp the tab and apply tension to the tab.

7. The cutting apparatus of claim 6, wherein both the knife holder and the tab support assembly are releasably secured to the cutting head via a shoe, the knife holder is coupled to a radially inward surface of the shoe and the tab support assembly is coupled to a radially outward surface of the shoe.

8. The cutting apparatus of claim 6, further comprising a positioning pin on one of the first and second support blocks and a corresponding slot on the other of the first and second support blocks, wherein the corresponding slot is elongated such that when the positioning pin in located in the corresponding slot at least one of the first and second support blocks slides along a longitudinal axis thereof relative to the other of the first and second support blocks as the first and second support blocks translate in the opposite directions.

9. The cutting apparatus of claim 6, wherein the lifting means lifts the first and second support blocks radially away from the knife holder with the tab clamped between the first and second fingers to apply the tension to the tab.

10. The cutting apparatus of claim 6, wherein knife assembly comprises a plurality of the tab, the first support block has a plurality of the first finger, the second support block has a plurality of the second finger that are interdigitated with the first fingers of the first support block, and the first and second fingers are paired so that each pair of the first and second fingers is configured to clamp therebetween a distal end of a corresponding one of the tabs.

11. The cutting apparatus of claim 10, wherein the slicing knife and the tabs each produce a two-dimensional shaped cut and the strip-cut product has four sides each having a shaped surface that is not flat.

12. The cutting apparatus of claim 10, wherein the first and second fingers extend parallel to the slicing knife to stabilize the slice product after exiting the slicing knife and prior to encountering the tabs.

13. The cutting apparatus of claim 6, further comprising rotating feed disks having radial legs adapted to assist in moving the slice product through the tabs to produce the strip-cut product, wherein the adjacent pairs of the first and second fingers define slots therebetween through which the radial legs of the feed disks pass so that each of the radial legs engages a portion of the slice product moving between an adjacent pair of the tabs.

14. The cutting apparatus of claim 6, wherein the cutting head has a plurality of the knife assembly arranged around the circumference of the cutting head.

* * * * *